US012662840B2

(12) United States Patent
Audenaerde

(10) Patent No.: US 12,662,840 B2
(45) Date of Patent: Jun. 23, 2026

(54) MOBILE PARASOL BASE, AND ASSEMBLY OF SUCH A PARASOL BASE AND A PARASOL

(71) Applicant: PLATINUM GROUP B.V., Breda (NL)

(72) Inventor: Kilian Ramon Audenaerde, Breda (NL)

(73) Assignee: PLATINUM GROUP B.V., Breda (NL)

( * ) Notice: Subject to any disclaimer, the term of this patent is extended or adjusted under 35 U.S.C. 154(b) by 359 days.

(21) Appl. No.: 18/022,103

(22) PCT Filed: Aug. 17, 2021

(86) PCT No.: PCT/NL2021/050509

§ 371 (c)(1),
(2) Date: Feb. 17, 2023

(87) PCT Pub. No.: WO2022/039593

PCT Pub. Date: Feb. 24, 2022

(65) Prior Publication Data

US 2023/0323697 A1 Oct. 12, 2023

(30) Foreign Application Priority Data

| | | |
|---|---|---|
| Aug. 18, 2020 | (NL) | 2026286 |
| Aug. 18, 2020 | (NL) | 2026287 |
| Mar. 18, 2021 | (NL) | 2027775 |

(51) Int. Cl.
*E04H 12/22* (2006.01)
*A45B 23/00* (2006.01)

(52) U.S. Cl.
CPC ..... *E04H 12/2246* (2013.01); *E04H 12/2238* (2013.01); *A45B 2023/0012* (2013.01)

(58) Field of Classification Search
CPC . E04H 12/2246; E04H 12/2238; F16B 21/04; A45B 2023/0012
USPC ..... 248/121; 135/15.1, 16
See application file for complete search history.

(56) References Cited

U.S. PATENT DOCUMENTS

| | | | | |
|---|---|---|---|---|
| 2,736,329 A * | 2/1956 | Cornellier | A45B 19/02 | 135/25.41 |
| 4,124,198 A * | 11/1978 | Wong | E04H 17/1602 | 256/73 |
| 5,121,579 A * | 6/1992 | Hamar | E04F 15/02044 | 52/297 |
| 6,220,260 B1 * | 4/2001 | Sachs | E04H 12/2215 | 135/15.1 |
| 6,471,176 B2 * | 10/2002 | Berthiaume | E04H 12/2269 | 248/529 |

(Continued)

FOREIGN PATENT DOCUMENTS

| | | |
|---|---|---|
| CA | 2759944 A1 | 5/2013 |
| EP | 1772575 A2 | 4/2007 |

(Continued)

*Primary Examiner* — Taylor Morris
(74) *Attorney, Agent, or Firm* — The Webb Law Firm

(57) ABSTRACT

Patio parasols are well known in which a parasol canopy is mounted to a parasol base to provide shade for a deck, patio, garden, or the like. The invention relates to a mobile parasol base. The invention also relates to an assembly of a parasol base according to the invention and at least one parasol mounted onto said parasol base.

21 Claims, 16 Drawing Sheets

(56) References Cited

U.S. PATENT DOCUMENTS

| | | | | |
|---|---|---|---|---|
| 7,614,600 | B1 | 11/2009 | Smith et al. | |
| 7,631,409 | B2 * | 12/2009 | Dehlsen | E01F 9/692 29/527.1 |
| 8,636,020 | B2 * | 1/2014 | Li | A45B 25/14 135/912 |
| 2005/0189005 | A1 | 9/2005 | Smith et al. | |
| 2007/0080277 | A1 | 4/2007 | Chen | |
| 2007/0187564 | A1 * | 8/2007 | McGuire | E04H 12/2261 248/346.5 |
| 2008/0224016 | A1 * | 9/2008 | Defu | E04H 12/2246 248/523 |
| 2008/0265110 | A1 * | 10/2008 | Helmonds | A45F 3/44 248/156 |
| 2017/0114563 | A1 | 4/2017 | Ye | |
| 2020/0208429 | A1 | 7/2020 | Ma | |
| 2022/0268049 | A1 * | 8/2022 | Frerich | A45B 23/00 |

FOREIGN PATENT DOCUMENTS

| | | | | |
|---|---|---|---|---|
| FR | 2512652 | A3 * | 3/1983 | E04H 12/2246 |
| GB | 2468847 | A * | 9/2010 | E02D 17/10 |
| GB | 2478274 | A * | 9/2011 | E04H 12/2238 |
| WO | 2005065279 | A2 | 7/2005 | |
| WO | WO-2015125116 | A1 * | 8/2015 | E04H 12/2238 |

* cited by examiner

MOBILE PARASOL BASE, AND ASSEMBLY OF SUCH A PARASOL BASE AND A PARASOL

CROSS-REFERENCE TO RELATED APPLICATIONS

This application is the United States national phase of International Application No. PCT/NL2021/050509 filed Aug. 17, 2021, and claims priority to The Netherlands Patent Application Nos. 2026286 filed Aug. 18, 2020, 2026287 filed Aug. 18, 2020, and 2027775 filed Mar. 18, 2021, the disclosures of which are hereby incorporated by reference in their entireties.

BACKGROUND OF THE INVENTION

Field of the Invention

The invention relates to a mobile parasol base. The invention also relates to an assembly of a parasol base according to the invention and at least one parasol mounted onto said parasol base.

Description of Related Art

Patio parasols are well known in which a parasol canopy is mounted to a parasol base to provide shade for a deck, patio, garden, or the like. If the parasol is of a so-called free-arm parasol, then its centre of gravity is no longer directly above the parasol base, considerable torque is be exerted on the mount and may tend to cause the parasol to topple over. Even when the parasol canopy is not extended (folded out), breezes can exert forces on the parasol canopy tending to topple it. In applications where the parasol will be used in only a single, fixed location, a parasol can e.g. be bolted to an in-ground parasol base, providing a sufficiently secure mount to resist such torque. However, in many applications it may be desirable to be able to move the parasol around to various locations, or to be able to store the parasol when not in use without an parasol base being left in place.

Such applications call for a mobile or portable parasol base, in particular a wheeled mobile parasol base. The mobile parasol base must also be able to withstand the forces exerted by the parasol without toppling, and without being anchored to the fixed world. Known mobile parasol bases are typically made of concrete, marble or granite to provide sufficient weight to the mobile parasol base or are designed to support separate heavy counterweights, such as concrete blocks or tiles, which are positioned removably on top of a parasol base frame.

Both options lead to a number of problems in practice. However, as such, moving of the known parasol bases is heavy and therefore laborious and inconvenient. Moreover, the upper surface of the concrete counterweight degrades in the course of time, which not affects the original colour of the parasol base, but also stimulates the growth of e.g. moss, bacteria, and fungi. Furthermore, the uniform (monochrome) aesthetical appearance of the concrete parasol base is often considered as unattractive. Secondly, the cost of shipping heavy weight makes it economically impractical to include the counterweights along with the parasol's package. And often, these counterweights will have to be purchased separately by a consumer in a separate store. In addition, there is the problem of the parasol owner or installer having to haul the heavy parasol base or heavy counterweights to the location where the parasol will be used, which may easily lead to injury to the person. Furthermore, part from the fact that wheeled mobile parasol bases are relatively easy to be relocated, wheeled mobile parasol bases suffer from the drawback that the weight to be borne by and on top of a wheel supported frame of the parasol base is limited, which will affect the stabilization of a parasol connected to said wheeled parasol base. There is a need for a more attractive wheeled parasol base which can be installed and transported in a more user-friendly manner. There is also a need to improve the stabilization and/or a load capacity of a wheeled parasol base.

SUMMARY OF THE INVENTION

It is a first object of the invention to provide an improved mobile parasol base without suffering from one or more of the abovementioned drawbacks.

It is a second object of the invention to provide an improved wheeled mobile parasol base without suffering from one or more of the abovementioned drawbacks.

At least one of these objects can be achieved by the parasol base, in particular a mobile parasol base according to the invention, comprising: a support base, one or more counterweight blocks supported by said support base. Preferably, the support base is formed by a support frame, which support frame comprises at least three mutually fixed arms extending in different directions, wherein adjacent arms mutually enclose an accommodating space and/or wherein the arms mutually enclose one or more accommodating spaces, wherein each accommodating space is typically configured to accommodate at least a mass increasing substance and/or mass increasing component, in particular a counterweight block; optionally, one or more, preferably removable, counterweight blocks inserted or insertable or creatable into at least one accommodating space, preferably, the parasol base comprises a plurality of wheels, wherein each wheel is connected by means of a wheel bracket to the support base, in particular to a terminal portion of an arm, and wherein each arm is preferably provided with at least one support element for supporting at least a portion of at least one counterweight block, such that, preferably, a lower side of each counterweight block is positioned below an upper side of the wheels. The wheeled mobile parasol base according to the invention has several advantages. A first advantage over known heavy, single-piece parasol bases is that the parasol base according to the invention makes use of modular counterweights which can be inserted, typically individually, into an accommodating space, which renders the base weight of the parasol base (without counterweights) relatively low, which facilitates handling, transportation, and manual displacement of the parasol base. Additionally, it is conceivable that in fact the accommodating space itself is configured for receiving and holding a mass increasing substance. To this end preferably at least one accommodating space, preferably each accommodating space, comprises at least a bottom wall and a circumferential wall, said bottom and circumferential wall together defining a mass receiving space. This allows a mass increasing substance and/or mass increasing component, such as a counterweight block, to be easily deposited into the accommodating space. Another advantage of the wheeled parasol base according to the invention is that a fixed support frame is used, which makes the support frame relatively robust and firm. Typically, the support frame is free of any hingeable portions and/or moving components, which makes the support frame less vulnerable, and which is in favour of the load capacity of the parasol base. Moreover, at least one accommodating space, preferably each accommodating space, and the support frame may be formed out of a single piece. This makes the parasol base even more firm and robust. Apart from the mutually fixed arms which increases the load capacity of the parasol base, the load capacity is further increased by lowering the centre of gravity of the parasol base due to the improved positioning of the counterweight blocks below an upper side (upper level) of the wheels. This improved load capacity allows a parasol base with a certain weight to be loaded with a relatively large parasol, optionally a free-arm parasol, and/or allows the parasol to be stably used in more turbulent weather conditions. The terminal portion of each arm can be formed by an outer end of each arm, but may also be formed by a part of the arm facing away from the centre of the parasol base (where the arms come together). The wheel bracket is typically fixed, for example by screwing and/or clamping, to an arm, wherein preferably the arm comprises an opening and/or a slot with which the wheel bracket can co-act. To this end, the wheel bracket is preferably provided with an upwardly protruding element, such as a pin, which can be inserted into said slot and/or opening of an arm, such that the wheel bracket is fixed to said arm. The parasol base according to the invention is configured for supporting and/or co-acting with at least one parasol. It is conceivable that the parasol base according to the invention is configured to simultaneously support and/or co-acts with a plurality of parasols. It is also imaginable that the wheeled parasol base according to the invention is configured to support other objects, like umbrellas, tent poles or (traffic or information) signs.

Preferably, the arms extend evenly across a cross-sectional plane of the parasol base. This means that in case n arms are applied, wherein $n \geq 3$, the angle enclosed by two adjacent arms will be 360/n degrees. Such an even distribution of the arms across the cross-section of the parasol base typically leads to a balanced load capacity. Hence, preferably, the accommodating spaces have substantially identical sizes. This also allows to use counterweight blocks with uniform dimensions, which is in favour of the user-friendliness of the parasol base. Preferably, the support frame comprises four arms, preferably four mutually fixed arms extending, from a centre portion of the base, in different directions. More preferably, said four arms are cruciform, wherein adjacent arms have a mutually perpendicular orientation. The arms of the support frame preferably enclose at least one receiving space for receiving part of a parasol shaft and/or for receiving part of a base tube configured to receive (a part of) a parasol shaft. The base tube may for example be provided with a screw or bolt or other mechanical fixating element to fixate the parasol shaft within the base tube. However, it is also conceivable that the base unit is provided with an inner diameter, for example by making use of an adapter ring, which inner diameter matches with the outer diameter of the parasol shaft to stabilize the parasol shaft in the base tube. This results in a relatively stable configuration of the base tube and the parasol shaft, and hence the parasol base and the parasol shaft, and/or may contribute to a more stable positioning of the parasol shaft, and thus the parasol as such. Preferably, the receiving space is substantially cylindrical. In this way, the co-action between the receiving space and the parasol shaft can be further optimized. It is conceivable that the substantially cylindrical receiving space tapers from the upper part towards a lower part of the receiving space. Preferably, the parasol base comprises a base tube configured to receive a parasol shaft, wherein the at least one receiving space is provided with at least one locking element, and wherein the base tube is provided with at least one counterlocking element configured to co-act with said locking element for securing the base tube in axial direction (vertical direction). More preferably, the at least one locking element comprises: at least one locking slot, preferably a plurality of locking slots provided in the base tube, at least one protrusion, preferably a plurality of locking protrusions, and a provided to the support frame and preferably located within the receiving space, wherein at least one locking protrusion is configured to be located in at least one locking slot, in coupled condition of the support frame and the base tube. It is imaginable that the locking protrusion(s) will, preferably resiliently, deform during insertion of the base tube into the receiving space, and will lock the base tube in place in a final position of the base tube in the receiving space. In this case, each locking element may act as snapping element. It is also imaginable that the locking protrusion(s) will not deform during installation of the base tube, wherein each locking protrusion may, for example, be formed by a substantially rigid notch. Each locking protrusion may act as guiding element for guiding the locking slot, wherein the guiding element may comprises opposite guiding surfaces. Preferably the height of at least one locking protrusion matches the width of at least one locking slot. Installation of the base tube may be realized by simply downwardly moving the base tube in the receiving space. It is imaginable that the at least one locking element and at least one counterlocking element define a bayonet lock closure, wherein, typically, a linear downward movement may be followed by axial rotation of the base tube. Preferably, the base tube is made of metal and/or plastic.

It is preferred that a bottom surface of the receiving space is provided with a drainage hole. As such, water seeping down from the shaft may be discharged without accumulating inside the parasol base.

It is conceivable that adjacent arms of the support frame enclose at least one reinforcement rib and preferably multiple reinforcement ribs. The reinforcement ribs can further contribute to the stability and/or rigidity of the support frame. Preferably a terminal portion of at least one, preferably each arm is provided with a plurality of arm reinforcement ribs. These arm reinforcement ribs may extend from the terminal portion of the arm either perpendicularly and/or parallel to the arm. These ribs may yield a better structural integrity of the parasol base, such as a higher torsional stiffness. However, primarily these arm reinforcement ribs are configured to strengthen the portion where the wheels are connected to the arm, to prevent the wheel, and in particular the wheel bracket, from being torn through the parasol base. It is conceivable that an interior portion of the terminal portion of each arm is threaded, such that the wheel bracket can be easily screwed into the arm. This is in particular beneficial in case the support frame is formed out of a single piece.

In yet a further preferred embodiment, the support frame is made of a single piece. Such embodiment benefits of a relatively simple configuration and may also positively contribute to the ease of use. The support frame may for example be at least partially made of plastic. Preferably, the support frame is substantially entirely made of plastic. It is for example conceivable that the plastic comprises one or more plastic materials. Non-limiting examples of plastic materials which can be applied are Polypropylene (PP), Polyethylene Terephthalate (PET, PET-P and/or PET-G), Polycarbonate (PC), Acrylonitrile Butadiene Styrene (ABS and/or ABS-PC), Polyethylene (PE), Low-Density Polyethylene (LDPE), High-Density Polyethylene (HPDE), Acrylonitrile Styrene Acrylate (ASA), Polymethyl Methacrylate (PMMA), Polyamide 6 (Pa6), Polyvinyl Chloride (PVC, HPVC and/or CPVC). Suitable production processes to produce such a single piece support frame are thermoforming and injection-moulding. The most preferred production process typically depends on the exact design of the support frame.

Each wheels is typically positioned underneath at least a portion, in particular the terminal portion, of an arm. The wheel bracket is typically connected to a centre portion of the wheel, and preferably extends from there in upward direction toward the above positioned arm. The wheel bracket may be a unilateral wheel bracket, wherein the wheel bracket only faces a single side of the wheel, but is typically more preferred, from a constructional point of view, to apply a bilateral wheel bracket, wherein the wheel bracket partially encloses opposite sides of the wheel. This bilateral wheel bracket is typically fork-shaped. Typically, each wheel bracket is at least partially positioned underneath at least a portion, in particular the terminal portion, of an arm. This positioning will commonly improve the carrying capacity of the parasol base as such.

The wheels may also be referred to as casters. The wheels (or casters) are commonly made of at least one of the materials chosen from the group consisting of: rubber, plastic, nylon, aluminium, or stainless steel. It is imaginable that at least one wheel has a fixed orientation with respect to the arm to which the wheel is connected. Such a fixed wheel is also referred to as rigid caster, and is configured to roll along a straight line path. It is typically (also or alternatively) preferable that at least one wheel is displaceably connected, in particular pivotably connected, to one of the arms. Such a wheel is often also referred to as a swivel caster. Like the simpler rigid caster, a swivel caster incorporates a wheel mounted to a—typically fork-shaped—wheel bracket including a swivel joint above the wheel allowing a lower part of the wheel bracket, and hence the wheel as such, to freely rotate about a vertical axis of rotation, typically (but not necessarily) about 360°, thus enabling the wheel to roll in any direction. It is conceivable that all wheels of the parasol base are swivel casters. Often, either all wheels or swivel casters or some wheels are rigid casters and at least one other wheel is a swivel caster. Other wheel types, such as omnidirectional wheels and/or spherical wheels may also be used. One or more wheels used in the parasol base according to the invention may be provided with a brake or a brake feature, which prevents the wheel from turning. This is commonly achieved using a lever, mounted onto the wheel presses, which is able to press a brake cam against the wheel. It may also be advantageous, in particular in case of a swivel caster, to apply a lock or a locking feature, mounted onto the wheel bracket, which is configured to realize an additional rotational lock on a vertical shaft of the wheel bracket so that neither the shaft can rotate or the wheel can turn, providing very rigid support. Preferably, each wheel has a (horizontal) axis of rotation. Preferably, the lower side of each counterweight block is positioned in between an upper side of the wheels and said axis of rotation of the wheels. Although it is imaginable that a lower side of the counter blocks is positioned underneath the axis of rotation of the wheels, which could lead to a further improved stabilization of the parasol base, such a positioning might affect the transportability of the parasol base, in particular on uneven ground. Hence, it is typically preferred to position the lowest point (the lower side) of the counterweight blocks in between the upper level (upper side) of the wheels and the axis of rotation of the wheels, to find a balance between load capacity improvement and transportability of the wheeled parasol base according to the invention. Preferably, at least one support element is positioned below an upper side of the wheel. A counter weight block resting on said support element will therefore also be positioned below said upper side of the wheel to lower the centre of gravity of the parasol base as much as reasonably possible (taking the desired unhindered transportability into account). The counterweight blocks may be entirely positioned on top of the support element, but it is also imaginable that a part of a counterweight extends below said support element (in installed condition). Preferably, at least one support element is at least partially formed by a protruding rim, preferably laterally protruding rim, which more preferably extends in a substantially horizontal direction. It is imaginable, and even favourable, in case each arm is provided with at least two support elements for supporting two different counterweight blocks. Preferably, each arm is provided with at least two support elements positioned in two different accommodating spaces. Often, but not necessarily, at least one support element defines a lower side of each arm, which allows the counterweight blocks to be supported by (rather than suspended or hung onto) the support elements. It is favourable in case at least, and preferably each, support element is provided with at least one opening configured to receive a downwardly protruding bulge of a counterweight block. This fixates and stabilizes the counterweight block with respect to the support structure, and hence with respect to the support base, in particular the support frame.

In a preferred embodiment, a terminal portion of each arm has a reduced thickness with respect to the thickness of a remaining portion of each arm, wherein each wheel is connected to a terminal portion (having the reduced thickness) of an arm. This support frame design allows the arms, and hence the support elements, to be positioned at a level below the upper side of the wheels, while at the same time providing sufficient and even improved robustness and rigidity to the arms.

It is conceivable that facing support elements of adjacent arms are integrally connected with each other. In this manner, an open, semi-open, of closed support wall (bottom wall) can be realized for supporting a mass increasing substance and/or mass increasing component, such as a counterweight block. In this embodiment, it is also imaginable that the terminal portions of adjacent arm are also mutually connected by an upstanding (typically substantially vertical) circumferential wall, which would lead to one or more, either separated or interconnected, container-like accommodating spaces configured to accommodate a mass increasing substance, such as a counterweight block. In this manner, the support frame, including the support elements (bottom walls) and circumferential walls could be integrally connected, and preferably made out of a single piece. It is conceivable that the support frame enclosed a single accommodating space for receiving a mass increasing substance and/or mass increasing component. This single accommodating may, as such, be composed of a plurality of interconnected accommodating space segments. Typically, each arm is preferably formed by at least one beam. These beams could be made of a solid material, but preferably each beam is formed by a (hollow) extrusion profile. Typically each beam is made of metal. It is imaginable that each arm is formed by a plurality of interconnected beams. This allows, for example, to realize the aforementioned preferred embodiment in which a terminal portion of each arm has a reduced thickness with respect to the thickness of a remaining portion of each arm, without having to post-process or cut-away a part of the beam, which is efficient and saves material losses and production time. To this end, it is preferable that each arm is formed by a plurality of interconnected beams having mutually different beam lengths. It is favourable in case at least two arms are formed out of at least one shared beam. This will increase the strength and load capacity of the support frame and hence of the parasol base. Typically, the arms define together a single planar plane, typically a substantially horizontal plane.

Preferably, at least two arms are interconnected by at least one cross-bar, more preferably positioned at a distance from the centre portion of the parasol base, wherein each cross-bar is configured to support at least one counterweight block. Each cross-bar may is typically fixed to adjacent arms, in particular to one or more support elements of adjacent arms. Preferably, each outer end of each cross-bar is enclosed in between an upper and a lower support element of an arm, wherein said two support elements mutually enclose a cross-bar insertion space. Possibly, the counterweight blocks are slid laterally (in a substantially horizontal direction) into (a lateral access opening of) the accommodating space, wherein the blocks will slide over the aforementioned upper support element, without being hindered by the cross-bar (lying underneath said upper support element). By supporting the outer ends of a cross-bar by the lower support elements, unwanted detachment of the cross-bar, can be prevented or at least counteracted, which thus leads to an improved reliability and durability and load capacity of the parasol base according to the invention. It is also conceivable that the counterweight blocks are positioned into the accommodating space from a substantially vertical direction. Hence, the counterweight blocks can be vertically inserted and a top panel can be positioned upon or above at least part of the counterweight blocks after said blocks have been installed.

Preferably, each counterweight block comprises a container with at least one filling opening for filling the container with a mass increasing substance, such as sand or water, wherein said at least one filling opening is preferably closable by a closing lid and/or by the top panel (if applied). Preferably, each counterweight block comprises a container, wherein said container comprises at least one bottom wall and at least one circumferential wall connecting to said bottom wall, wherein the circumferential wall defines a filling opening of the container for filling the container with a mass increasing substance, such as sand or water. Hence, the filling opening of the container may be formed by an open upper side of the container, which can be closed off by a lid and/or by the top panel (if applied). Preferably the parasol base comprises one or more closing lids, wherein each lid is configured to co-act with, preferably to be clamped onto, a circumferential wall of a container for substantially closing the container. The lid may be formed by the top panel (if applied) being to simultaneously close off a plurality of the containers, and/or may be formed by individual lids, wherein each lid is configured to close off a container, and wherein the lids are preferably at least partially covered by the top panel (if applied). Preferably, the top panel directly covers, and preferably directly engages, the support frame and/or the counterweight block(s), without intermediate plate or structure in between. This simplifies the construction of the parasol base, and reduces the cost price of the parasol base as such.

Preferably, at least one, and more preferably, each container comprises at least one. preferably linear, drainage channel (or gutter) to drain (rain) water away from (an accommodating space for) the mass increasing substance. This prevents undesired wettening and fouling of the mass increasing substance by (rain) water (or any other liquid dropped onto the parasol base). Said drainage channel(s) is(/are) preferably formed by an upper section of the circumferential wall of the container. Here, it is e.g. conceivable that the drainage channel is formed by a deformed wall part, in particular circumferential wall part, of the container. However it is also conceivable that a side wall, in particular circumferential wall of the parasol base, in particular the support frame, which partially defines the accommodating space, and/or at least one counterweight block is provided with a, preferably linear, drainage channel, preferably wherein at least a part of said drainage channel is downwardly inclined in a direction facing away from the centre of the support frame. The drainage channel is preferably located near at an upper edge, more preferably an upper outer edge of the container. Said drainage channel may for example be situated adjacent and/or parallel to, a part of, the circumferential wall part of the container and/or the upward rim of a lid of the container. Preferably, each drainage channel is provided with an at least partially, and preferably entirely, inclined bottom surface. In a preferred embodiment the drainage channel is downwardly inclined in a direction facing away from the centre of the support frame. In order to ensure a good drainage of (rain) water a lowest point of the bottom surface of said drainage channel is preferably provided with a drainage hole. The angle of the drainage channel may for example be situated between 10 and 40 degrees, preferable 25 degrees. Preferably, said drainage hole is provided such that water is discharged from the drainage channel between an inner wall (interior wall) of at least one accommodating space and an exterior wall of the parasol base. Hence, said drainage hole may connect the drainage channel to an underneath drainage space enclosed by spaced, preferably vertical, walls of the parasol base, in particular an inner wall defining a part of at least one accommodating space, and a spaced outer wall defining an exterior wall of the parasol base. That is, the parasol base may be provided with a double circumferential wall, such that water can be discharged therebetween. This allows to discharge the water in a way that is unobtrusive to the eye, which leaves the exterior of the parasol base clean. More preferably, a lowest point of the bottom surface of said drainage channel is formed by at least one corner piece or corner section of said counterweight. To this end the at least one corner piece, in particular the lowest point of the bottom surface, may be provided with at least one drainage hole, which allows water to be discharged to the surroundings. However, it is furthermore conceivable that the lowest point is situated elsewhere along the drainage channel, or that the water is discharged along the sides of the container. The (rain) water may thus be discharged to the surroundings by means of a drainage hole provided in the drainage channel and/or corner piece, or may be drained along the side of the container or counterweight block, as long as it is prevented that the (rain) water could flow into a container. This prevents that (rain) water will flow into the container, and hence may foul the container and/or the mass increasing substance contained by said container, and furthermore prevents damage of the parasol base e.g. due to frost. Preferably, the top panel (if applied) covers the drainage channels at least partially, and preferably substantially entirely. This prevents the drainage channels to be seen be persons, and reduces the amount of water to be discharged via the drainage channels.

It is advantageous in case each container is configured to support the top panel (if applied), to distribute the downward force (gravitational force) exerted by the top panel (and possible additional external loads) over a relatively large surface area, to stabilize the top panel and to prevent peak stress in the parasol base, which could lead to damage. Here, it is in particular advantageous in case each container is provided with a plurality of upstanding (vertical) ridges (baffles), wherein at least one of those ridges extends to a top surface (top level) of the container to support an overlaying top panel. One or more of these ridges may divide the container into a plurality of compartments. To improve the rigidity of the (hollow) container, it is favourable in case at least two ridges have a perpendicular orientation with respect to each other, and/or wherein outer ends of each ridge are connected to another container part. It is further favourable that each container can be secured with respect to the support frame. To this end, the support frame and/or each counterweight block, in particular each container, may be configured to realize a clamp connection, a snap connection (click connection) and/or other kind of lock connection to lock the container in place with respect to the support frame, as a result of which undesired removal of the container from the support frame can be prevented. This clamp connection or snap connection can, for example, be realized by providing the support frame and/or the container with one or more locking hooks, in particular clamping hooks and/or snapping hooks, which hooks are configured to co-act with a recess or other type of counterlocking element to secure the container with respect to the support frame. Preferably, at least one clamp connection and/or snap connection and/or other kind of lock connection is realized at or near the corners of the parasol base, and hence near the terminal portions of the arms (and/or corner pieces connected thereto) of the support frame.

By applying fillable counterweight blocks, the initial weight can be kept relatively low, which is in favour of transporting and handling the blocks. In order to further reduce weight, it may be preferable that the container does not comprise its own closing lid, wherein the closing off of the container(s) is realized by means of the (central) top panel.

The parasol base preferably comprises at least one counterweight block. It is also conceivable that the counterweight block comprises multiple counterweight block parts. The counter weight block may for example comprises four counter weight block parts which are mutually connected, wherein each counter weight block part van be inserted into an accommodating space defined by adjacent arms of the support frame. It is also conceivable that the top panel (if applied) and at least one counterweight block are mutually connected or that at least one counterweight block forms integrally part of the top panel. Such embodiment may further simplify the configuration of the parasol base and reduce the number of components.

It is imaginable that, in installed condition, each counterweight block extends with respect to the terminal portion of each adjacent arm. In this manner the arms, and hence the support frame as such, can be protected by the counterweight blocks once installed. Preferably, at least a part of at least one counterweight block has a substantially triangular cross-section, more preferably an isosceles triangle having two sides of equal length, and/or a frustoconical cross-section. This shape typically matches the shape of the accommodating space, as a result of which the empty space within an accommodating space and when the counterweight block(s) is/are installed can be kept to a minimum. Preferably, at least one counterweight block has an increasing cross-section in upward and/or downward direction. This changing cross-section across the height of the counterweight blocks could be used to allow the counterweight blocks to be installed in a predefined manner into the accommodating space, and could prevent wrongful, for example upside-down, installation of the counterweight blocks. Moreover, the changing cross-section across the height of the counterweight blocks could be used to shift the centre of gravity in downward direction and/or more towards the centre portion (central zone) of the parasol base. Preferably, all counterweight blocks are identical. It is, however, also imaginable that at least two counterweight blocks have distinctive shapes and/or dimensions. The counterweight blocks are typically at least partially rigid, and may e.g. at least partially be composed of concrete, although it is also conceivable to apply one or more flexible counterweight blocks, such as e.g. sand bags or water bags. The counterweight block typically, though not necessarily, comprises a housing, preferably a plastic housing, wherein said housing may form integral part of the support frame. Here, the housing typically comprises a bottom wall and at least one side wall, wherein said bottom wall and at least one side are connected to adjacent arms to define a container-like accommodating space to accommodate a mass increasing substance. In this exemplary embodiment, the housing of the counterweight block, integrated with the support frame, will not be removable from the support frame.

Preferably, a part of a circumferential wall of each counterweight block defines a part of a peripheral edge of the parasol base. The peripheral edge of the parasol base preferably surrounds (encloses) all arms and wheels of the parasol base. Preferably, an end surface of each arm is connected to a corner piece defining a part of a peripheral edge of the parasol base. The corner pieces make part of the support frame of the parasol base. Preferably, each corner piece is connected tightly and/or locked with respect to an arm. Preferably, the orientation between a corner piece and an adjacent arm is substantially fixed. The corner pieces protect the arms of the support frame, and, moreover, can be used to provide additional functionality the support frame as will be elucidated below. It is, for example, imaginable that, in installed condition, each corner piece is connecting, at opposite sides, to (a circumferential wall of) at least two counterweight blocks, which allows the formation of a substantially closed peripheral edge of the parasol base. The parasol base may further comprise a top panel, in particular a tile, configured to at least partially cover the support frame and/or the counterweight block(s), wherein the support frame and/or the counterweight block(s) is/are provided with a plurality of upward rims, which upward rims together define a top panel insertion space in which the top panel is, preferably releasably, positioned. Each corner piece preferably comprises a support surface for supporting a top panel positioned on top of at least a portion of each corner piece. Hence, the corner piece may be configured, and is preferably configured, to bear the top panel at least partially. Typically the top panel is additionally supported by the arms and/or the counterweight blocks of the parasol base. However, the corner pieces may be used together to lock the top panel in place, at least within a horizontal plane, and possibly also in a vertical plane. To this end, each corner piece may, for example, provided with at least one upward rim, wherein the upward rims together define a top panel insertion space for insertion of a top panel, such that at least a part of the arm and a part of the counterweight blocks is covered by said top panel. An inner surface of each upward rim of a corner piece preferably has an angular (hooked) shape, which is preferably substantially complementary with respect to an outer surface of a corner of the top panel, such the top panel corners, and hence the top panel as such, can be locked and held in place by the corner piece of the support frame. Preferably, an outer part of a circumferential wall of each counterweight block is provided with an upward rim, wherein the rims together define a top panel insertion space for insertion of a top panel, such that at least a part of the arm and a part of the counterweight blocks is covered by said top panel. Preferably an inner surface of all upward rims together is designed to co-act or lie adjacent or near to an outer surface of the top panel. Preferably, the top panel is locked by the upward rims within said top panel insertion space, at least in a horizontal plane. The upward rims may mutually be positioned at a distance from each other, which allows it, for example, to secure merely the corners of the top panel. It is, however, also imaginable that the upward rims together form a substantially closed circumferential upward rim. It is imaginable that at least one upward rim makes integral part of the support frame. However, often (separate) corner pieces are provided to the support base, in particular the support frame, to form the upward rim(s). Preferably, an end surface of each arm of the support frame is connected to and/or forms a corner piece provided with an upward rim for defining the top panel insertion space. The top panel is preferably releasably positioned within the top panel insertion space and can therefore easily be removed and/or replaced. The top panel is typically completely enclosed by the adjoining upward rims. In this way, the top panel can be protected against e.g. breakage. Preferably the parasol base according to an aspect of the present invention is a modular parasol base, which makes it easier and lighter to move the parasol base (in steps) to another location. The top panel may have a decorative upper surface, which is generally more attractive than traditional concrete. Moreover, the top panel preferably covers the support base, in particular the support frame, and the counterweight(s) at least partially, which will improve the lifetime of the parasol base. Moreover, in this way, the exposure of the support base, in particular the support frame, and the counterweight(s), to weather influences, in particular rain, can be reduced, which will reduce the risk of fouling and/or the growth of moss and fungi onto at least a part of said support base, in particular said support frame, and the counterweight(s). The top panel is typically a flat panel, in particular a tile. The tile is typically at least partially made of ceramic, and/or plastic and/or stone. The top panel typically has a square or oblong shape. The top panel is preferably releasably positioned within the top panel insertion space and can therefore easily be removed and/or replaced. It is imaginable that the top panel is modular top panel which is composed of a plurality of, preferably interconnected or interconnectable, panel pieces. Preferably a top surface of the top panel is smooth to impede growth of e.g. moss, bacteria, and fungi on top of said panel. Preferably, the top panel is impermeable to water. An additional advantage of applying the top panel is that the top panel obviously also has a certain mass, as a result of which the top panel has a counterweight function, which allows the actually intended counterweight(s) to be designed, in a lighter, and hence smaller, and more practical manner. Preferably, the top panel, in particular the tile is typically at least partially made of plastic, ceramic, glass, and/or stone, such as marble, concrete and/or granite. It is imaginable that the top panel is formed by a laminate of layers, such as e.g. a core layer and a decorative layer affixed on top of said core layer. The top panel typically has a square or oblong shape. The top panel is used to cover at least a substantial part the support frame and a part of the counterweight parts. This is not only attractive from an aesthetical point of view, but also shields the (often corrosion sensitive) support frame substantially from weather conditions, which is in favour of the lifetime of the parasol base. Moreover, the top panel prevents the—preferably fillable—counterweight blocks to open and to drain its mass increasing substance. Since the top panel is a flat panel only covering a top side of the support frame (and a top side of the counterweight blocks), the top panel typically has a limited weight and can be installed relatively easily. The top panel is typically provided with a decorative design at its top surface. The top panel may be a monolith panel, but may also be a laminated panel consisting of a plurality of interconnected layers. The top panel is considered as part of the parasol base according to the invention. Preferably, the height of the upward rims of the corner pieces and/or the circumferential wall of the counterweight blocks is substantially identical to the height of the top panel. This allows the upwards rims to connect smoothly to an upper surface of the top panel, which not only is preferred from an aesthetical point of view, but also improves the cleanability of the top panel as fouled water is able to easily flow from the top panel. Moreover, in this manner, the vulnerable and sharp (corner) edges of the top panel can be protected and covered by the collective of upward rims, which is in favour of the lifetime of the parasol base, and prevents personal injuries.

Commonly, the parasol base is configured to support a stem part and/or shaft part of a parasol. This stem part or shaft part is typically fixed, e.g. by means of screws and/or clamping, onto the parasol base. To this end, it is favourable in case the parasol base comprises a base bracket and/or a base tube, which is typically positioned on top of and secured with respect to the support frame and/or—if applied—the top panel. The base bracket is configured to be stably support a parasol, and is typically at least partially insertable into a parasol shaft. The base bracket may be a static (rigid) base bracket, although it is typically more preferred that the base bracket comprises a stationary part, mounted onto the support frame, and a rotatable part, pivotably connected to said stationary part and allowing a parasol shaft, once mounted, to be (axially) rotated. Preferably a clamping structure is used to (releasably) clamp the base bracket onto the support frame, in particular at least one upper beam of said support frame. The clamping structure may comprise bolts and/or pins guided through through-holes of the support frame, wherein an upper outer end of each bolt and/or pin is preferably configured to co-act, either directly or indirectly, with the base bracket, and wherein and a lower outer end of each bolt and/or pin is preferably configured to co-act, either directly or indirectly, with a base plate of the clamping structure, positioned within or underneath the support frame, in particular at least one upper beam of said support frame. Said base plate is configured to (firmly) keep the base bracket in place. The clamping structure, which is configured to be clamped onto the support frame, to stabilize the base bracket and to hold the base bracket in place, makes it possible to transmit all or most of the forces exerted (by a parasol) onto the base bracket to the support frame rather than to the top panel. This means that the typically vulnerable top panel will not, or predominantly not, be exerted to (considerable) forces during use of the parasol base, which is in favour of the lifetime of the top panel, and hence of the parasol base as such. It is also conceivable that at least one base bracket forms part of a parasol which is configured for co-action with at least one parasol base. The base tube is configured to accommodate a lower outer end section of the parasol shaft. The base tube may be connected to the aforementioned base bracket. However, it is typically preferred that the base tube is connected, preferably locked, to the parasol base. A base bracket may in this latter case be omitted. Further details on a preferred connection between the parasol base and the (optional) base tube are given below.

The invention also relates to a parasol base, in particular a mobile parasol base according to the invention, comprising a support base, one or more counterweight blocks supported by said support base, and preferably a top panel, in particular a tile, configured to at least partially cover said support base and/or said counterweight block(s), wherein the support base comprises at least one support element for supporting at least a portion of at least one counterweight block, such that a lower side of each counterweight block is positioned below an upper side of the wheels.

The invention also relates to an assembly of a parasol base according to the invention and at least one parasol, preferably removably, mounted onto said parasol base. In this patent document, frequently reference is made to "the support frame", although it is conceivable that in various of described embodiments instead of a support frame another type of support base can be used. In these embodiments, the expression "support frame" could be replaced by "support base".

Expressions like "horizontal" and "vertical" are relative expressions related to the parasol base, wherein "vertical" means in a direction perpendicular to a plane defined by the parasol base, and wherein "horizontal" means in a direction parallel to or coinciding with said plane defined by the parasol base.

Preferred embodiments of the present invention are set out in the following non-limitative clauses.

Clauses

1. Mobile parasol base, comprising:

a support frame, which support frame comprises at least three mutually fixed arms extending in different directions, wherein adjacent arms mutually enclose an accommodating space, preferably said accommodating space is configured for accommodating a mass increasing substance, in particular a counterweight block, optionally, at least one, preferably removable, counterweight block, preferably a plurality of counterweight blocks, inserted or insertable or creatable into at least one accommodating space, a plurality of wheels, wherein each wheel is connected by means of a wheel bracket to a terminal portion of an arm, and preferably a top panel, in particular a tile, configured to at least partially cover said support frame and/or said counterweight block, wherein the terminal portion of each arm is, optionally, provided with an upward rim, wherein the upward rims together define a top panel insertion space in which the top panel is positioned, and wherein each arm is, optionally, provided with at least one support element for supporting at least a portion of at least one counterweight block, such that a lower side of each counterweight block is positioned below an upper side of the wheels.

2. Parasol base according to clause 1, wherein the top panel is locked by the upward rims within said top panel insertion space, at least in a horizontal plane.

3. Parasol base according to clause 1 or 2, wherein at least one upward rim makes integral part of the support frame.

4. Parasol base according to one of the foregoing clauses, wherein an end surface of each arm is connected to and/or forms a corner piece provided with an upward rim for defining the top panel insertion space.

5. Parasol base according to one of the foregoing clauses, wherein, in installed condition, each upward rim, and preferably each corner piece, is connecting, at opposite sides, to at least two counterweight block parts.

6. Parasol base according to clauses 4 or 5, wherein each corner piece comprises a support surface for supporting a top panel positioned on top of at least a portion of each corner piece.

7. Parasol base according to one of the foregoing clauses, wherein an outer part of a circumferential wall of each counterweight block is provided with an upward rim, wherein the rims together contribute to define a top panel insertion space for insertion of the top panel.

8. Parasol base according to one of the foregoing clauses, wherein the height of the upward rims of the corner pieces and/or the circumferential wall of the counterweight block is substantially identical to the height of the top panel.

9. Parasol base according to one of the foregoing clauses, wherein the parasol base is configured to support a stem part or shaft part of a parasol.

10. Parasol base according to one of the foregoing clauses, wherein the accommodating spaces have substantially identical sizes.

11. Parasol base according to one of the foregoing clauses, wherein the support frame comprises four arms, preferably four mutually fixed arms, extending, from a centre portion of the base, in different directions.

12. Parasol base according to clause 11, wherein the four arms enclose at least one receiving space for receiving a part of a parasol shaft.

13. Parasol base according to clause 12, wherein the receiving space is substantially cylindrical.

14. Parasol base according to any of the preceding clauses, wherein adjacent arms of the support frame enclose at least one reinforcement rib and preferably multiple reinforcement ribs.

15. Parasol base according to any of the preceding clauses, wherein the support frame is made of a single piece.

16. Parasol base according to any of the preceding clauses, wherein the support frame is at least partially made of plastic.

17. Parasol base according to any of the preceding clauses, wherein the top panel and at least one counter weight block are mutually connected.

18. Parasol base according to any of the preceding clauses, wherein at least one counter weight block forms integrally part of the top panel.

19. Parasol base according to any of the preceding clauses, wherein each wheel is positioned underneath the terminal portion of an arm.

20. Parasol base according to any of the preceding clauses, wherein each wheel bracket is at least partially positioned underneath an arm.

21. Parasol base according to any of the preceding clauses, wherein a part of each wheel bracket is inserted into the arm.

22. Parasol base according to any of the preceding clauses, wherein at least one wheel has a fixed orientation with respect to the arm to which the wheel is connected.

23. Parasol base according to any of the preceding clauses, wherein at least one wheel is displaceably connected, in particular pivotably connected, to one of the arms.

24. Parasol base according to any of the preceding clauses, wherein each wheel has an axis of rotation, and wherein the lower side of each counterweight block is positioned in between an upper side of the wheels and an axis of rotation of the wheels.

25. Parasol base according to any of the preceding clauses, wherein at least one support element is positioned below an upper side of the wheel.

26. Parasol base according to any of the preceding clauses, wherein at least one support element is at least partially formed by a protruding rim, preferably laterally protruding rim.

27. Parasol base according to any of the preceding clauses, wherein each arm is provided with at least two support elements for supporting two different and/or adjacent counterweight blocks or counterweight block parts.

28. Parasol base according to any of the preceding clauses, wherein each arm is provided with at least two support elements positioned in two different accommodating spaces.

29. Parasol base according to any of the preceding clauses, wherein at least one support element defines a lower side of each arm.

30. Parasol base according to any of the preceding clauses, wherein a terminal portion of each arm has a reduced thickness with respect to the thickness of a remaining portion of each arm, wherein each wheel is connected.

31. Parasol base according to any of the preceding clauses, wherein each arm is formed by at least one beam.

32. Parasol base according to clause 31, wherein each arm is formed by a plurality of interconnected beams.

33. Parasol base according to clause 32, wherein each arm is formed by a plurality of interconnected beams having mutually different beam lengths.

34. Parasol base according to one of the clauses 31-33, wherein at least two arms are formed out of at least one shared beams.

35. Parasol base according to one of the foregoing clauses, wherein the parasol base comprises a base bracket, positioned on top of and secured with respect to the support frame and/or, if applied, the top panel, wherein said base bracket is configured to support a parasol, and in particular to be secured to a parasol.

36. Parasol base according to clause 35, wherein the parasol base comprises a clamping structure configured to clamp the base bracket onto the support frame, in particular onto at least one upper beam of said support frame.

37. Parasol base according to one of the clauses 35-36, wherein the top panel is locked between the support frame and the base bracket.

38. Parasol base according to one of the clauses 35-37, wherein the base bracket is secured with respect to the support frame, such that forces exerted onto the base bracket are substantially transmitted to the support frame rather than to the top panel.

39. Parasol base according to one of the foregoing clauses, wherein the arms define together a single planar plane.

40. Parasol base according to one of the foregoing clauses, wherein at least two arms are interconnected by at least one cross-bar, preferably positioned at a distance from the centre portion of the parasol base, wherein each cross-bar is configured to support at least one counterweight block.

41. Parasol base according to one of the foregoing clauses, wherein each counterweight block comprises a container with at least one filling opening for filling the container with a mass increasing substance, such as sand or water, wherein said at least one filling opening is preferably closable by a closing lid and/or by the top panel 42. Parasol base according to one of the foregoing clauses, wherein each counterweight block comprises a container, wherein said container comprises at least one bottom wall and at least one circumferential wall connecting to said bottom wall, wherein the circumferential wall defines a filling opening of the container for filling the container with a mass increasing substance, such as sand or water, wherein each container is closable by a lid and/or a top panel of the parasol base.

43. Parasol base according to clause 42, wherein the parasol base comprises a plurality of closing lids, wherein each lid is configured to co-act with, preferably to be clamped onto, a circumferential wall of a container for substantially closing the container.

44. Parasol base according to clause 42 or 43, wherein each container comprises at least one drainage channel to drain rain water away from the filling opening of the container and/or away from an accommodating space for the mass increasing substance.

45. Parasol base according to one of the foregoing clauses, wherein, in installed condition, each counterweight block extends with respect to the terminal portion of each adjacent arm.

46. Parasol base according to one of the foregoing clauses, wherein at least a part of at least one counterweight block has a substantially triangular cross-section.

47. Parasol base according to one of the foregoing clauses, wherein at least one counterweight block has an increasing cross-section in upward direction.

48. Parasol base according to one of the foregoing clauses, wherein a part of a circumferential wall of each counterweight block defines a part of a peripheral edge of the parasol base.

49. Parasol base according to one of the foregoing clauses, wherein an end surface of each arm is connected to a corner piece defining a part of a peripheral edge of the parasol base.

50. Parasol base according to one of the foregoing clauses, wherein an end surface of each arm is connected to a corner piece defining a part of a peripheral edge of the parasol base.

51. Parasol base according to clause 49 or 50, wherein each corner piece is provided with an upward rim, wherein the upward rims together define a top panel insertion space for insertion of a top panel, in particular a tile, such that at least a part of the arm and a part of the counterweight blocks is covered by said top panel.

52. Parasol base according to one of the foregoing clauses, wherein an outer part of a circumferential wall of at least one, preferably each counterweight block is provided with an upward rim, wherein the rims together define a top panel insertion space for insertion of a top panel, in particular a tile, such that at least a part of the arm and a part of the counterweight blocks is covered by said top panel.

53. Parasol base according to clause 51 or 52, wherein the parasol base comprises at least one, preferably flat, top panel, in particular a tile, removably inserted into the top panel insertion space.

54. Parasol base according to one of the foregoing clauses, wherein the parasol base is configured to support a stem part or shaft part of a parasol.

55. Parasol base according to one of the foregoing clauses, wherein each accommodating space has a lateral access opening, wherein each counterweight is slidable into said lateral access opening of an accommodating space.

56. Parasol base according to one of the foregoing clauses, wherein each counterweight, in particular each container, is securable with respect to the support frame by means of at least one lock connection, in particular a clamp connection and/or a snap connection.

57. Parasol base according to one of the foregoing clauses, wherein the accommodating space is configured for accommodating a mass increasing substance, such as a counterweight block.

58. Parasol base according to one of the foregoing clauses, wherein at least one accommodating space, preferably each accommodating space, is defined by adjacent arms, and at least one a bottom wall and at least one circumferential wall situated in between said adjacent arms, wherein said bottom wall is preferably formed by interconnected support elements of said adjacent arms.

59. Parasol base according to clause 58, wherein the at least one bottom wall, and the at least one circumferential wall, and the support frame are formed out of a single piece.

60. Parasol base according to one of the foregoing clauses, wherein the arms of the support frame enclose at least one receiving space for receiving a base tube configured to receive a parasol shaft.

61. Parasol base according to clause 60, wherein the parasol base comprises a base tube configured to receive a parasol shaft, wherein the at least one receiving space is provided with at least one locking element and wherein the base tube is provided with at least one counterlocking element configured to co-act with said locking element for securing the base tube in axial direction.

62. Parasol base according to clause 61, wherein the at least one locking element comprises:

at least one locking slot, preferably a plurality of locking slots provided in the base tube, at least one protrusion, preferably a plurality of locking protrusions, and a provided to the support frame and preferably located within the receiving space, wherein at least one locking protrusion is configured to be located in at least one locking slot, in coupled condition of the support frame and the base tube.

63. Parasol base according to clause 61 or 62, wherein the at least one locking element and at least one counterlocking element define a bayonet lock closure.

64. Parasol base according to any of the clauses 60-63, wherein a bottom wall of the support element, which faces the receiving space for the base tube, is provided with a drainage hole.

65. Parasol base according to one of the foregoing clauses, wherein a terminal portion of at least one, preferably each arm is provided with a plurality of arm reinforcement ribs.

66. Parasol base according to clause 44, wherein the drainage channel is downwardly inclined in a direction facing away from the centre of the support frame.

67. Parasol base according to one of the foregoing clauses, wherein a side wall, in particular circumferential wall of the parasol base, which partially defines the accommodating space, and/or at least one counterweight block is provided with a drainage channel, preferably wherein said drainage channel is downwardly inclined in a direction facing away from the centre of the support frame.

68. Parasol base according to one of the clauses 44, 66, or 67, wherein at least one lowest point of the bottom surface of said drainage channel is provided with at least one drainage hole.

69. Parasol base according to clause 68, wherein said drainage hole connects the drainage channel to an underneath drainage space enclosed by spaced, preferably vertical, walls of the parasol base, in particular an inner wall defining a part of at least one accommodating space, and a spaced outer wall defining an exterior wall of the parasol base.

70. Assembly of a parasol base according to one of the foregoing clauses and at least one parasol mounted onto said parasol base, in particular onto a base bracket and/or base tube connected to said parasol base.

BRIEF DESCRIPTION OF THE DRAWINGS

The present invention will hereinafter be further elucidated on the basis of non-limitative exemplary embodiments shown in the following figures, wherein.

DESCRIPTION OF THE INVENTION

Figure 1A:
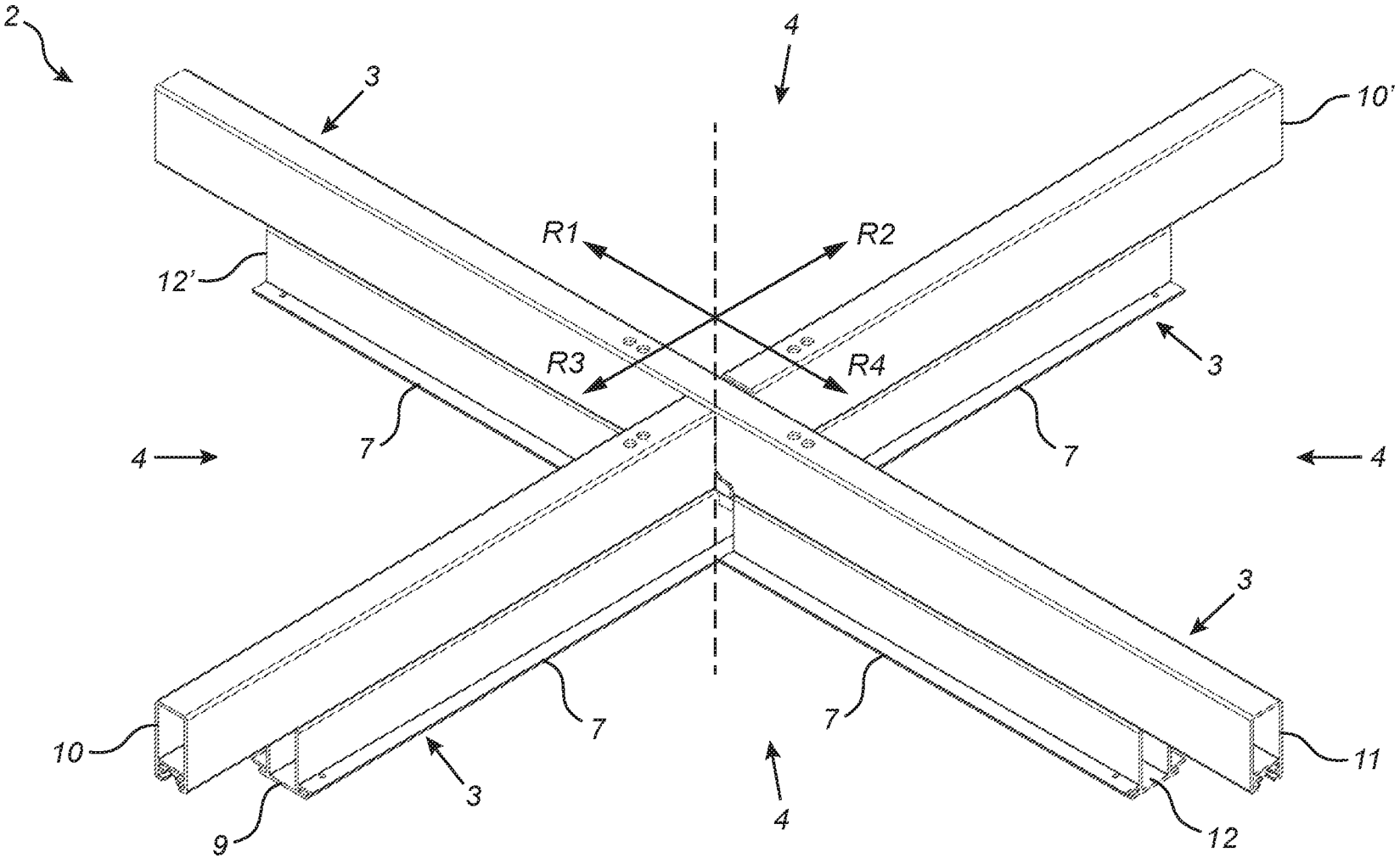
FIG. 1*a* gives a perspective view of the support frame of the parasol base according to the invention.

FIG. 1*a* shows a perspective view of the support frame 2 for the parasol base 1 according to the present invention. This particular non limitative example of the support frame 2 consists of four mutually fixed arms 3 extending in different directions R1, R2, R3, R4 from a central portion of the support frame 2. Each of the arms 3 of the support frame 2 in this figure is provided with a support element 7 for supporting a portion of a counterweight block (not shown in this figure). The support element 7 is formed by two rims on the arms 3 which are laterally protruding. The upper rim 7 is the one supporting the counterweight block, whereas the bottom rim is spaced below the upper rim 7 such as to receive a cross-bar 23 (see FIG. 1*b*) for reinforcement of the support frame 2 between said two rims. Preferably each arm 3 is provided with two of said support elements for supporting two different counterweight blocks as shown in the figure. The adjacent arms 3 extending in directions R1 and R2, R2 and R4, R4 an R3, R3 and R1, each mutually enclose an accommodating space 4. The accommodating space 4 is in this exemplary figure of substantially triangular shape and each set of said adjacent arms preferably are positioned substantially perpendicular. The arms 3 of the support frame 2 are drawn up by a plurality of interconnected beams 9, 10, 10', 11, 12, 12'. Said beams are in particular hollow beams as shown by the beams extending in the directions R3 and R4. The hollow beams can be easily extruded and thereby reduce cost of production.

The figure illustrates that a pair of opposing arms 3 is formed by a shared bottom beam 9 or a shared upper beam 11. A pair of second beams 10 and 10', 12 and 12' are connected to the shared beams 9 and 11 respectively, thereby forming the arms 3. The arms 3 extending in the directions R2 and R3 are constructed by the shared bottom beam 9. On a upper side of the shared bottom beam 9 the two second beams 10 and 10' are attached. Said pair of second beams 10, 10' are attached to the upper side of the shared bottom beam 9 on opposite sides of the shared upper beam 11. The shared upper beam 11 is shared by the arms extending in the directions R1 and R4. On a bottom side of the shared upper beam 11, on opposite sides of the shared bottom beam 9, the pair of second beams 12 and 12' is attached. Hence the support frame 2 is formed by a plurality of interconnected beams 9, 10, 10', 11, 12, 12' having mutually different lengths.

Figure 1B:
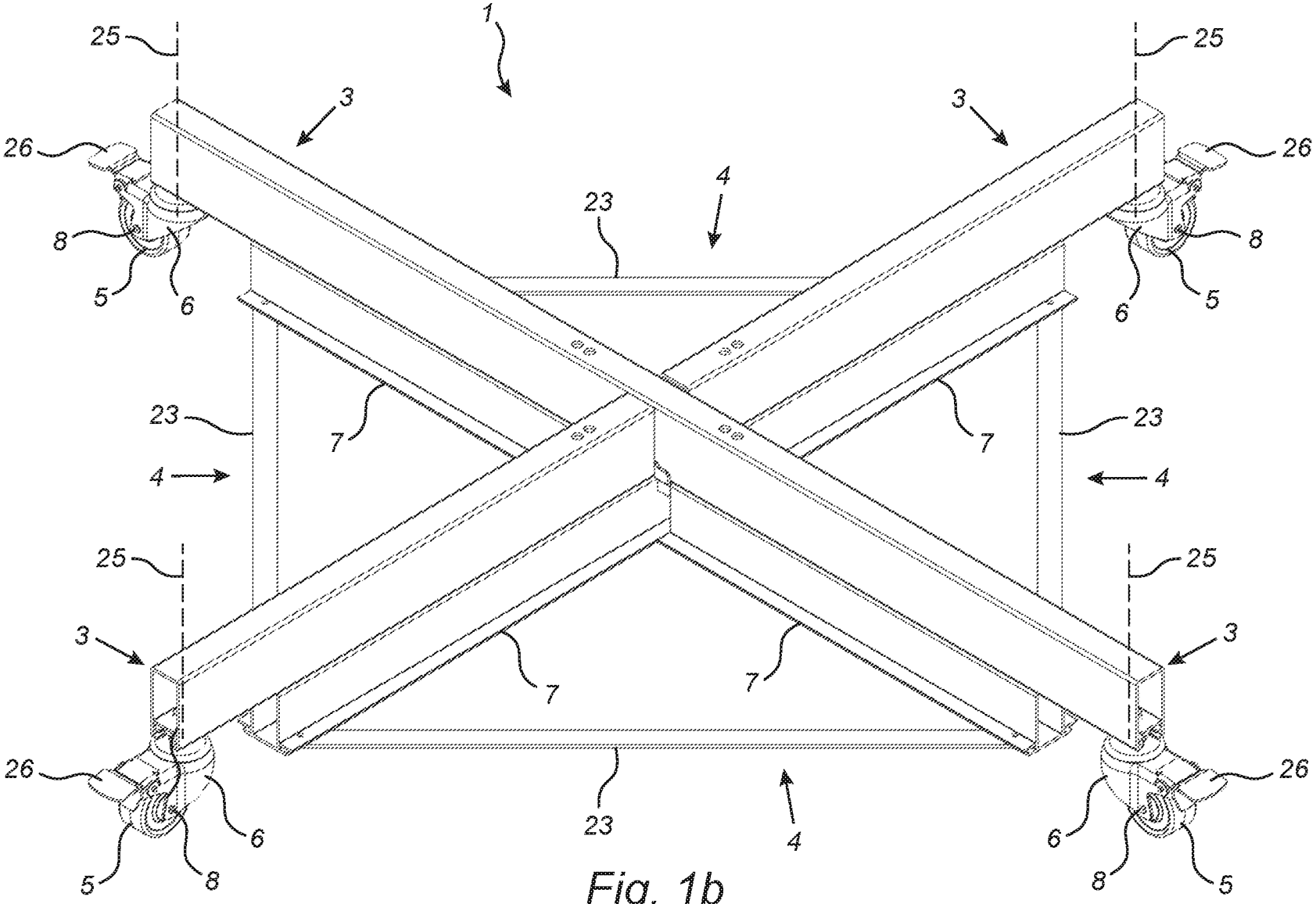
FIG. 1*b* shows the mobile parasol base comprising the support frame as shown in FIG. 1*a;*

FIG. 1*b* shows the mobile parasol base 1, which comprises the support frame 2 shown in FIG. 1*a*. The support frame 2 is further provided with cross-bars 23. The cross-bars 23 interconnect two adjacent arms 3. The cross-bars 23 increase the rigidity of the frame and furthermore provide additional support to the counterweight block (not shown). The cross-bars 23 are attached to the end portions of the bottom beams being part of the adjacent arms 3. This way the cross-bar 23 does not obstruct the accommodating space 4 and allows the counterweight block (not shown) to be inserted freely. The figure shows that the cross-bars 23 are inserted in between the two laterally protruding rims, wherein the top rim forms the support element 7 for the counterweight block. The use of the plurality of beams as elaborated in the foregoing figure defines a terminal portions of the arms 3 which has a reduced thickness with respect to the thickness of a remaining portion of the arms 3. In these terminal portions with reduced thickness wheels 5 are attached to the support frame 2. This allows the centre of mass to be placed as low to the ground surface as possible. The wheels 5 are connected to the support frame 2 through brackets 6. The brackets 6 are attached to a bottom surface of the upper beam of each arm 3. The wheels 5 are swivelable around a substantially vertical axis 25, and each wheel has an axis of rotation 8 which is substantially horizontal. The combination of the vertical axis 25 and the horizontal axis 8 allow the parasol base 1 to be easily movable in all desired directions. In order to secure the parasol base 1 on the preferred location, each wheel is provided with a manual brake 26. The manual brakes 26 are configured to move between a first position wherein the wheel can rotate freely around the axis of rotation 8, and a second position wherein the rotation of the wheel around axis 8 is at least partially obstructed.

Figure 2:
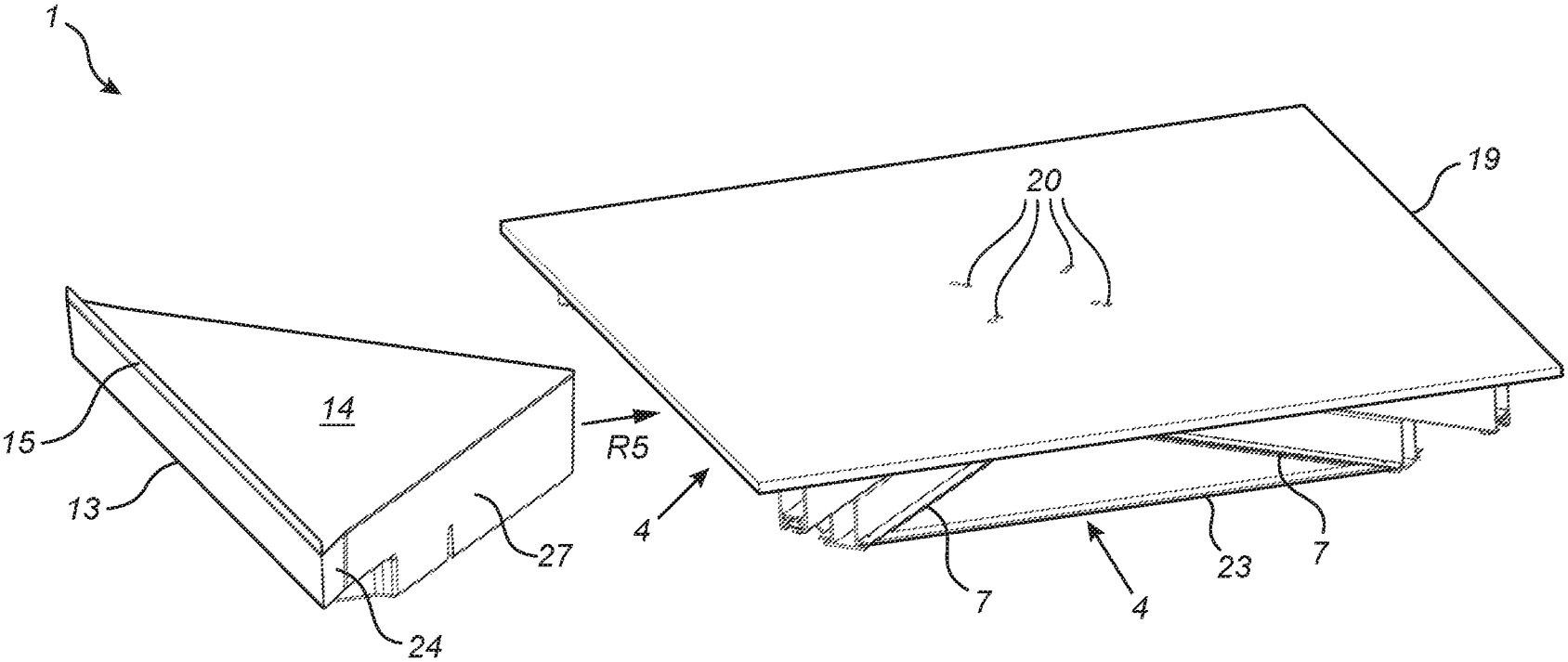
FIG. 2 gives a perspective view of the insertion of a counterweight block into the support frame.

In FIG. 2 a part of the parasol base 1 is shown. The figure provides a perspective view of a possible manner how a counterweight block 13 can be inserted into the support frame. The wheels 5 as shown in the previous figure are intentionally left out to elucidate a different aspect of the present invention. This figure shows a counterweight block 13 of substantially triangular shape positioned aside of the support frame 2. The support frame is provided with a top panel 19. Said top panel 19 comprises a plurality of holes 20 at a centre portion of the parasol base 1. These holes 20 are used for attaching a stem part of a parasol. The stem part can be attached either directly or indirectly—through a stem base bracket—to the top panel 19. In the shown non-limitative embodiment, the counterweight block 13 is configured as to slide in the accommodating space 4 of the parasol base 1. The counterweight block 13 can be positioned into the accommodating space 4 by a movement in the direction of the arrow R5. By moving the counterweight block 13 in said direction the movement is guided by the support elements 7. Once the counterweight block 13 is fully inserted, an upward rim 15, which is part of a closing lid 14, substantially covers a side wall of the top panel 19. To this end, is may also be conceivable that a drainage channel is provided, wherein said drainage channel may be adjacent and/or parallel to the upward rim 15 of the closing lid 14. The sides of the counterweight block 13 directed towards the arms 3, in this non-limitative figure, comprise main wall portion 27 and a position-finding wall portion 24. The position-finding wall portion 24 is positioned at an angle to the main wall portion 27, such that during the movement in the direction R5 the position-finding wall portion 24 co-acts with another part of the parasol base, in particular the corner piece 16 (not shown), to assure a correct position of the counterweight block 13. Once the counterweight block 13 is in its correct position it extends with respect to the terminal portion of each adjacent arm 3.

Figure 3A:
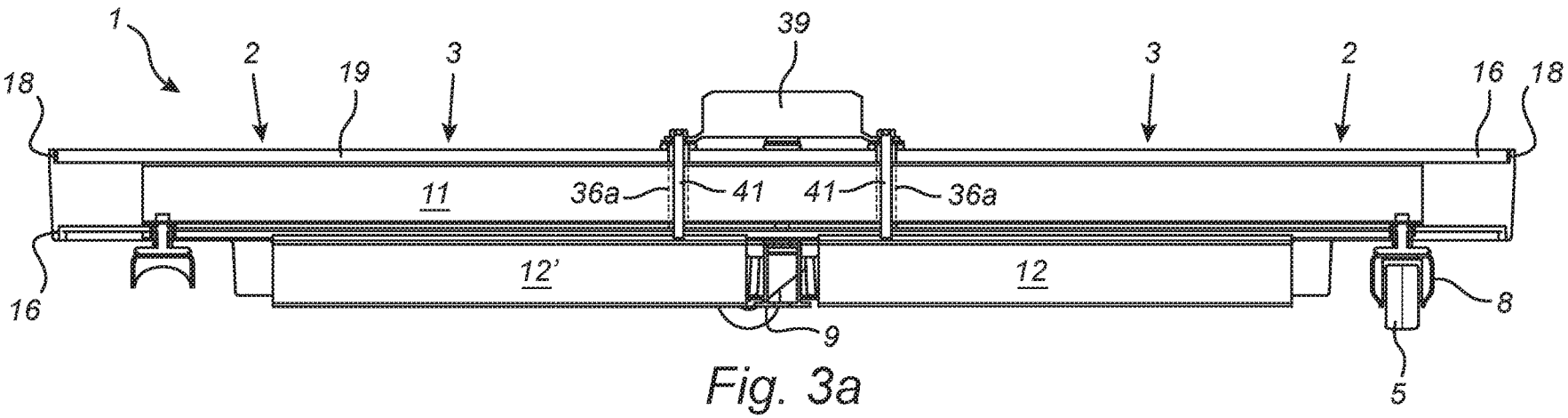
FIGS. 3*a* and 3*b* show a cross sectional view of the parasol base according an embodiment of the present invention.
Figure 3B:
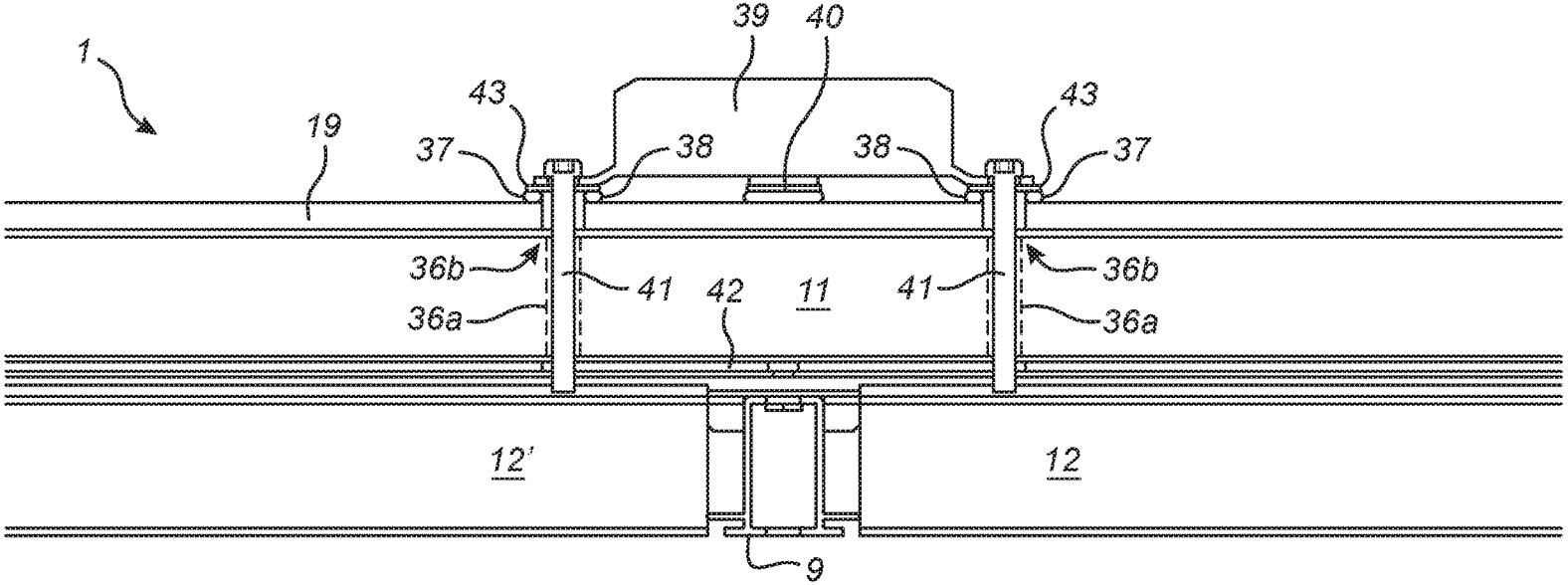
Figure 4A:
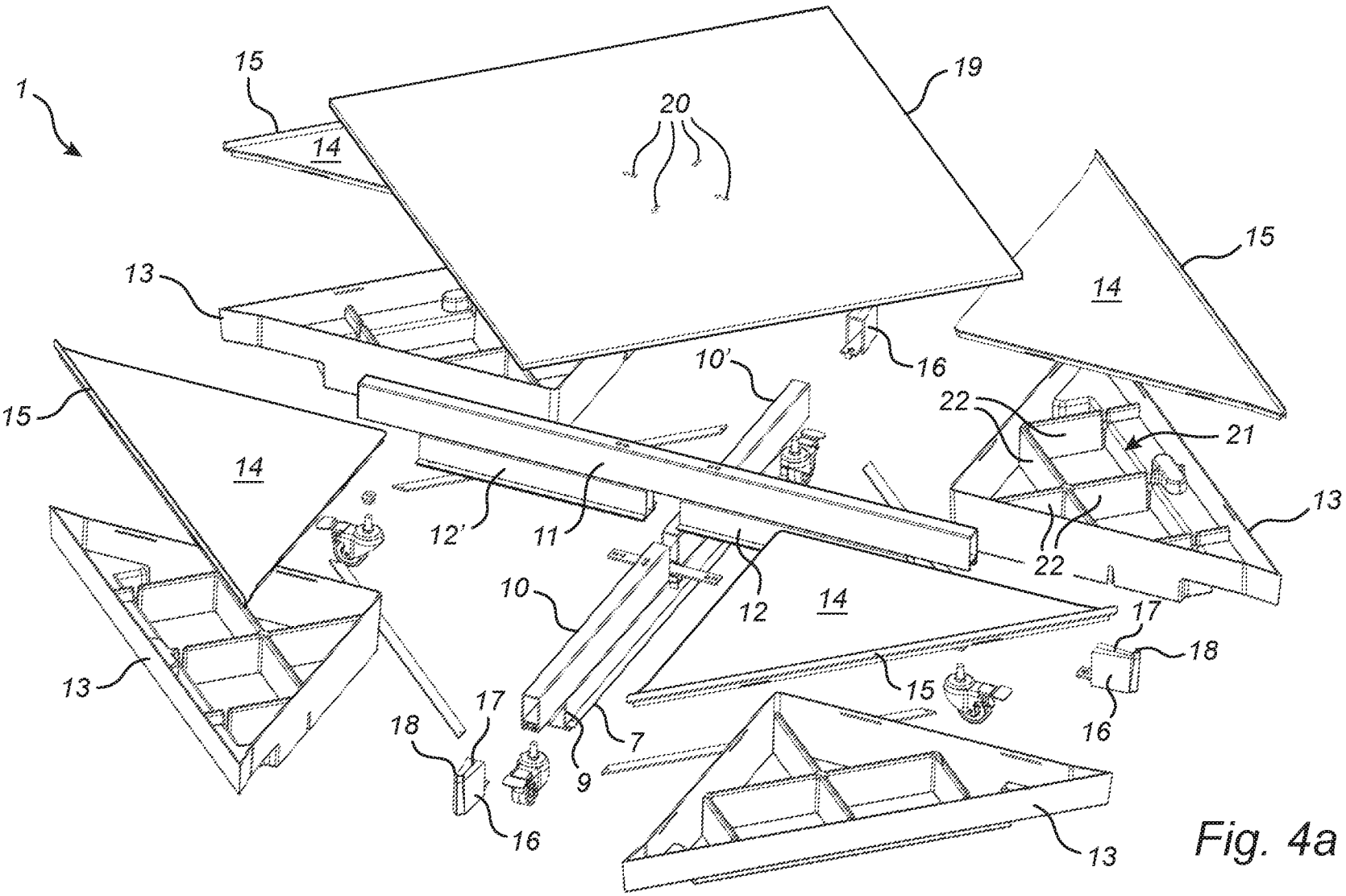
FIG. 4*a* shows an exploded view of the same parasol base as shown in FIGS. 3*a* and 3*b;*

FIG. 3*a* shows a cross sectional view of the parasol base 1 according to a non-limitative embodiment of the present invention, and FIG. 3*b* shows a corresponding detailed view of a centre part of the parasol base 1. Corner pieces 16 are located on the terminal portions of the arms 3 of the support frame 2. The support frame 2 in this figure is not entirely shown, merely the beams 9, 11, 12 and 12' are visible. The corner pieces 16 comprise an upward rim 18. The upward rims 18 of all corner pieces define a top panel insertion space. The upward rims 18 of the corner pieces 16 are defined such as to enclose at least a part of a corner of the top panel 19. The particular shape of the upward rims 18 of the corner pieces 16 is adapted to the shape of the corners of the top panel. Therefore, it is also conceivable that the upward rim 18 is adapted to a corner of a polygon shaped top panel 19 and is not limited to the illustrated form. The use of said corner pieces 16 allows to use a single top panel 19 for the entire parasol base 1. The top panel 19 may furthermore be secured to the base frame 2, either directly or indirectly, to establish a more secure connection. A parasol (not shown) can be mounted onto the parasol base 1 by securing the parasol to a base bracket 39 of the parasol base 1. Here, the base bracket 39 is typically at least partly inserted into a shaft of the parasol. Since, during use, the base bracket 39 is commonly exposed to significant forces, including rotational forces (torque), it is preferred that these forces are not, are at least not entirely, transmitted to the typically vulnerable top panel 19 to prevent damaging, and even breakage, of the top panel 19. This is preferably realized by transmitting most or all forces exerted onto the base bracket 39 to the upper beam 11 (as shown) and/or the lower beam(s) 12, 12'. To this end, the upper beam 11 is provided with a plurality of lower through-holes 36*a*, and the top panel 19 is provided with a plurality of upper through-holes 36*b*. Each lower through-hole 36*a* is positioned in line with one of the upper through-holes 36*b*. Typically the number of upper through-holes 36*b* is three, four, five, six, or eight. The same obviously applies to the number of lower through-holes 36*a*. A bush 37 (cylindrical spacer) is at least partially inserted into each upper through-hole 36*b*, wherein a lower end of each flanged bush 37 is configured to co-act with the upper beam 11, in particular an upper side 11*a* of the upper beam 11. On top of said bush 37 a washer 43 is positioned. Instead of applying a regular bush 37 with a washer 43 on top, one may also use a flanged bush. Preferably, a resilient O-ring 38 is positioned in between each washer 43 and an upper surface of the top panel 19. The O-ring 38 may for example be made of rubber. A centre portion of the base bracket 39 may be supported by the top panel 19 by using a, preferably resilient centre cushion 40, resilient sleeve, or any other, typically resilient and/or semi-rigid or rigid, support structure. The base bracket 39 is secured to the upper beam 11 by using securing elements 41, here formed by bolts 41, inserted into and extending with respect to each bush 37, washer 43, and the corresponding though-hole 36*a*, 36*b*. A lower end of each bolt 41 is screwed into a (threaded) hole of a frame bracket 42 and is configured to pull the base bracket 39 in downward direction towards the upper beam 12, as a result of which the base bracket can be secured. Since a lower end of each bush 37 is configured to co-act with the upper beam 11, tightening of the bolts 41 will predominantly lead to clamping of the upper beam 11 in between the frame bracket 42 and the bush 37/washer 43 assemblies, while forces exerted directly onto the top panel 19 can be kept to a minimum. The upward rims 18 of the corner pieces 16 and the upward rim 15 (not shown in this figure) of the counterweight blocks 13 together define a substantially consecutive rim which substantially covers the entire side wall of the top panel 19. The figure furthermore illustrates the fact that a lower side of each counterweight block is positioned in between an upper side of the wheels 5 and the axis of rotation 8. The lower side of the counterweight block 13 has to be placed below the upper side of the wheels once the counterweight block 13 is inserted into the parasol base 1 in order to ensure its low centre of mass FIG. 4*a* shows a perspective of an exploded view of the parasol base 1 as shown in FIGS. 3*a* and 3*b*. The exploded view provides a good overview of the individual features of the present invention. The exploded view illustrates an interior volume 21 of the counterweight blocks 13. The interior volume 21 of the counterweight block is defined by a container, wherein said container comprises at least one bottom wall and at least one circumferential wall connecting to said bottom wall, wherein the circumferential wall defines a filling opening 21 of the container. The interior volume 21 is separated in a plurality of segments by means of interior walls 22. These segments prevent the mass increasing substance to slosh in the interior volume 21. Sloshing can lead to undesirable forces when moving the parasol base 1 and can additionally change the centre of mass to an undesired location when positioning the base 1 on a slightly inclined surface possibly. The corner pieces 16 as shown in the exploded view reveal an upper surface 17. This upper surface 17 is, when the corner piece 16 is attached to the arm 3, positioned in the same plane as the upper surface of the arms 3. Said upper surface of the arms 3 together with the upper surface 17 carry the top panel 19 of the parasol base 1. A part of a circumferential wall of each of the counterweight blocks 13 defines a part of the peripheral edge of the parasol base 1. In particular the parts of the circumferential wall of the counterweight blocks 13 and the outward facing side of the corner pieces 16 define the entire peripheral edge of the parasol base 1. The figure also indicates the position of the frame bracket 38 in more detail. The holes provided in the frame bracket 38 are aligned with the holes 20, 36*b* in the top panel 19.

Figure 4B:
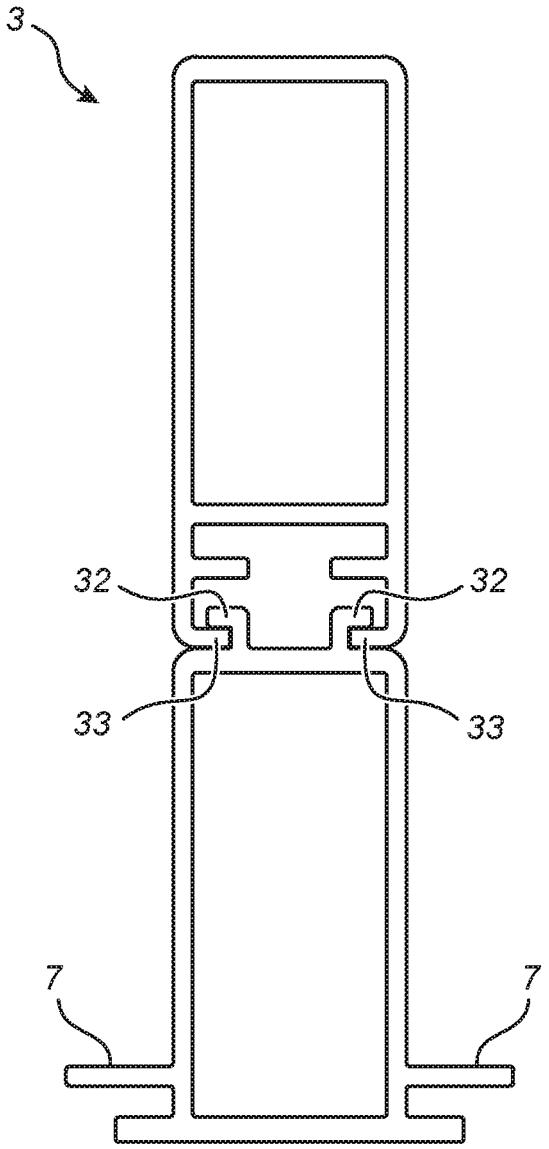
FIG. 4*b* shows a cross-sectional view of an arm of the support frame from FIG. 1.

FIG. 4*b* shows a cross-sectional view of two beams 34, 35 which together define an arm 3 of the parasol base 1. The two beams 34, 35 are attached to each other. To that end the upper beam 35 comprises two inwardly protruding outer ends 33 facing towards each other, wherein each of the outer ends 33 is configured to be slid into a receiving space. The receiving space is defined by two rims 32 on the upper surface of the bottom beam 34. The rims 32 are formed by a first section which is substantially perpendicular to the upper surface of the bottom beam 34, and a second section which is substantially parallel to the upper surface of the bottom beam 34. In particular the distance between the second section of the rim 32 and the upper surface of the bottom beam 34 defines the receiving space. The present invention is not limited to the described attachment of the two beams 34, 35. It is also conceivable that the outer ends 33 are protruding outwardly away from each other.

Figure 5:
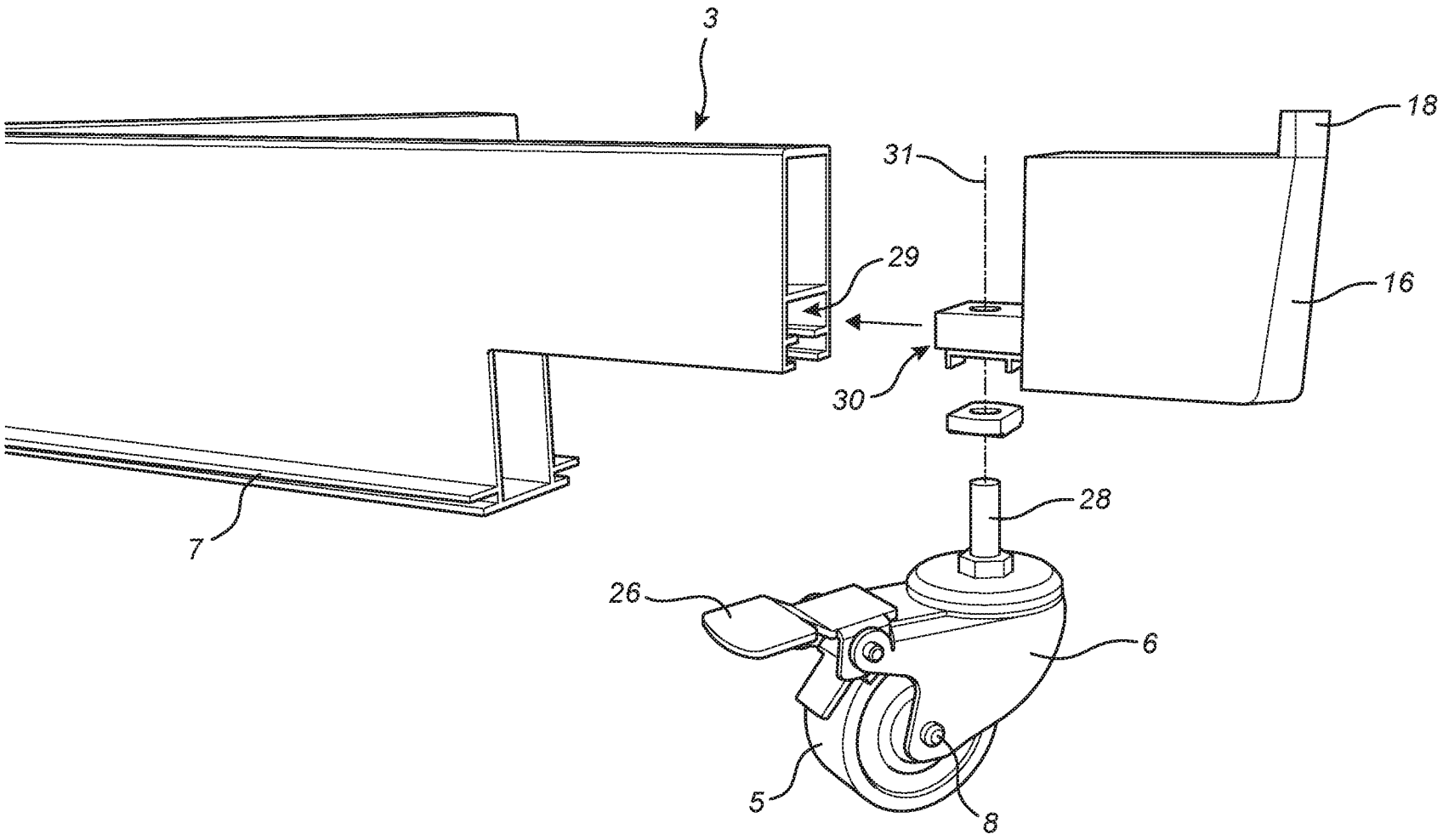
FIG. 5 shows a perspective view of the attachment of one of the wheels to the support frame.

FIG. 5 gives a perspective view of the assembly of one of the wheels 5. In this non limitative figure the arm 3 of the support frame 2 is drawn up by a single beam. At the terminal end of the arm 3 the arm 3 has a reduced thickness with respect to the remaining part of the arm 3. This terminal end of reduced thickness allows the wheel 5 to be attached as high as possible which yields a low centre of mass of the parasol base 1. The beam comprises the support element 7 which support at least a part of a counterweight block (not shown in this figure). As explained before, the wheel 5 is attached with its bracket 6 to the arm 3 of the support frame 2. The cross-sectional profile of the hollow arm 3 comprises a receiving segment 29, which is configured to receive a protrusion 30 of the corner piece 16. The receiving segment 29 is further configured to receive a pin 28 which is part of the wheel bracket 6, in particular the receiving segment comprises a hole on the bottom surface of the arm 3. The pin 28 of the wheel bracket 6 is inserted through the hole in the bottom surface (not shown) of the arm 3. Once the protrusion 30 of the corner piece 16 slides into the receiving segment 29 of the arm, it is locked into place by the pin 28 on the wheel bracket 6, said pin 28 slides into a receiving hole in the protrusion 30. In assembled condition the hole of the protrusion 30, the pin 28 of the bracket 6 and the hole in the bottom surface of the arm 3 share the same centreline 31. Preferably the receiving segment 29 of the cross-sectional profile of the arm 3 is dimensioned such that the protrusion 30 of the corner piece 16 snugly fits inside.

Figure 6:
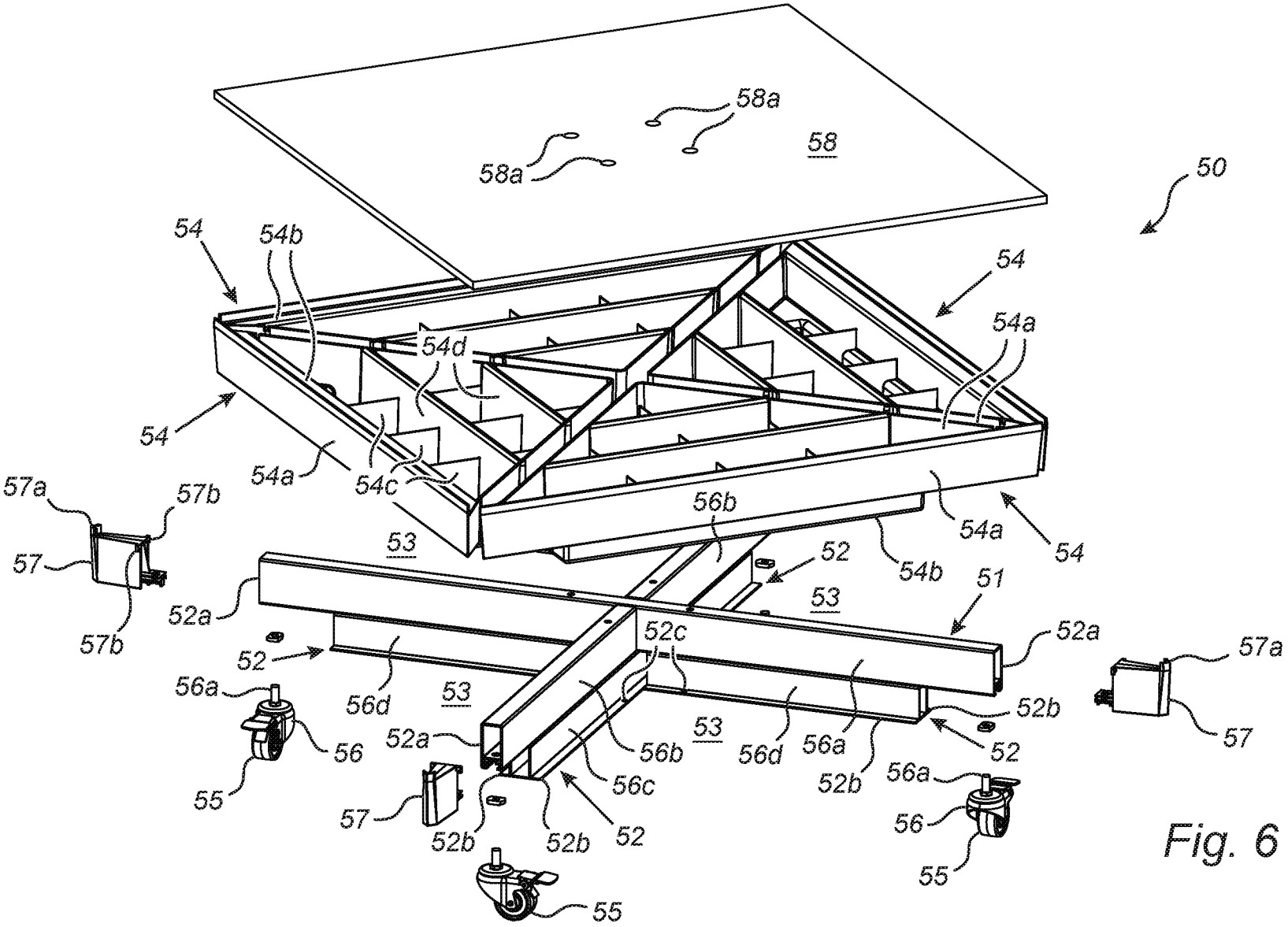
FIG. 6 shows an exploded view of another embodiment of a parasol base according to the invention.
Figure 7:
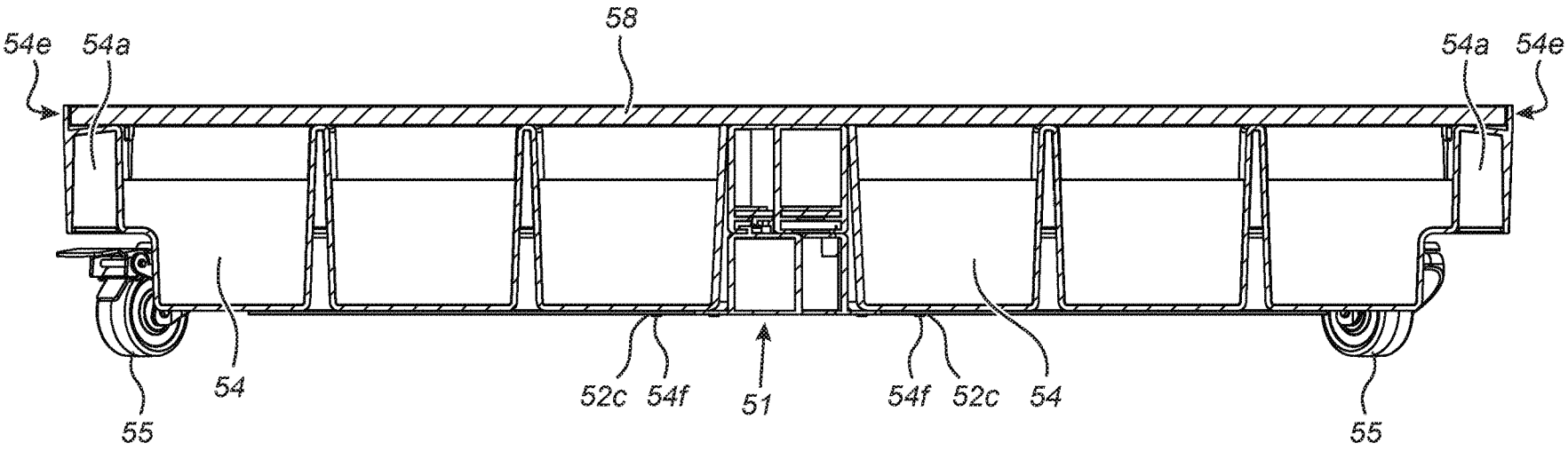
FIG. 7 shows a cross-sectional view of the parasol base according to figure.
Figure 8:
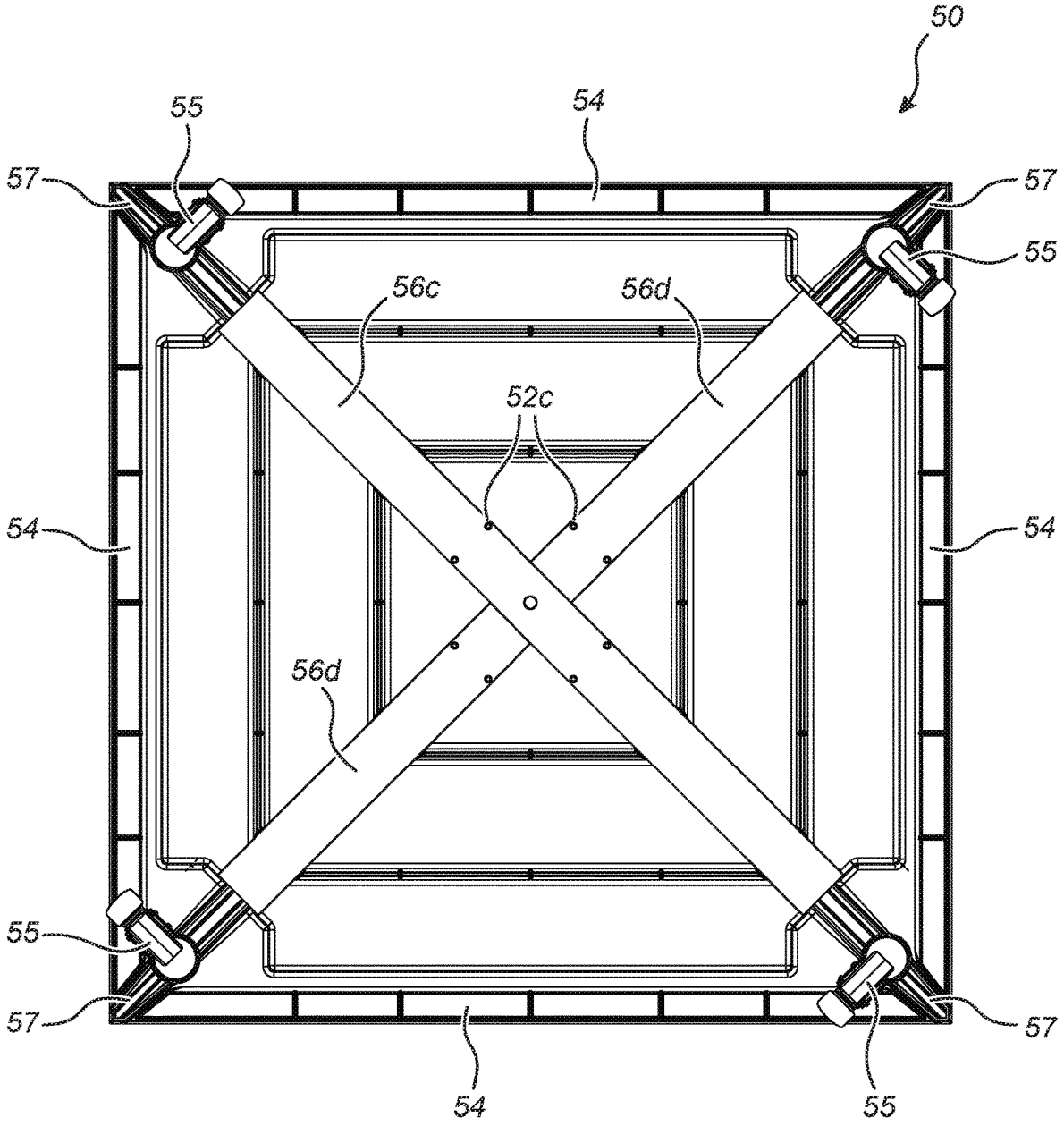
FIG. 8 shows a bottom view of the parasol base according to FIGS. 6-7.
Figure 9:
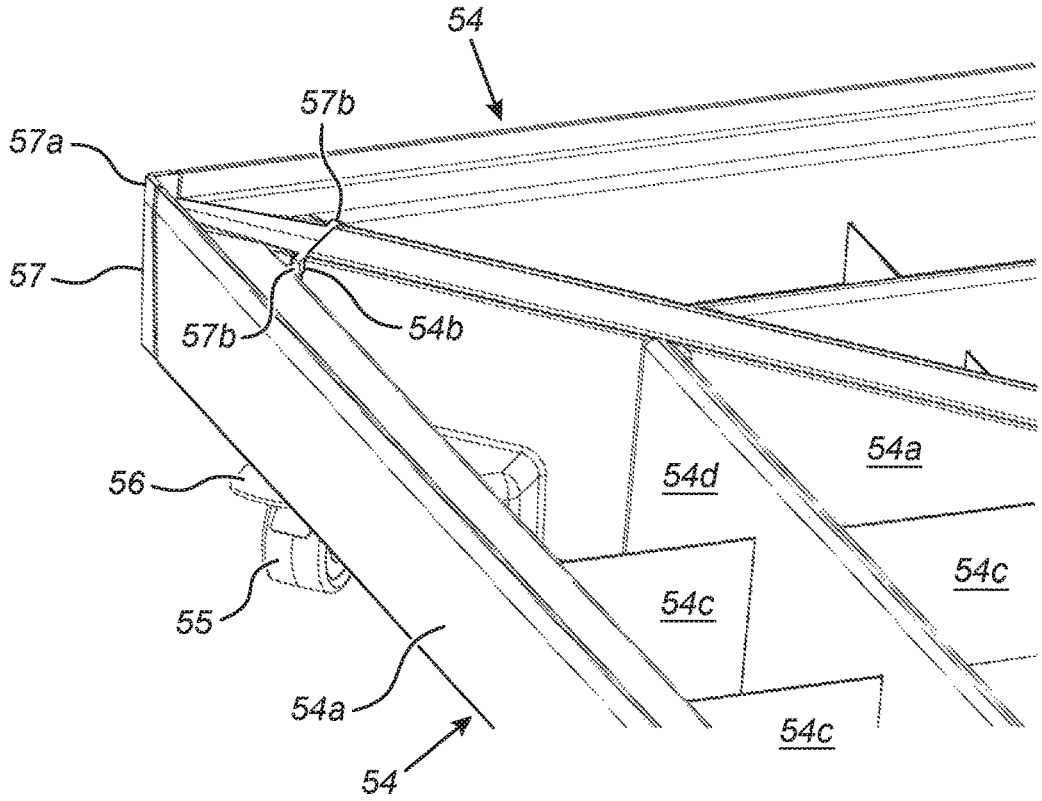
FIG. 9 shows a detailed view of a corner section of a part of the parasol base according to FIGS. 6-8.
Figure 10:
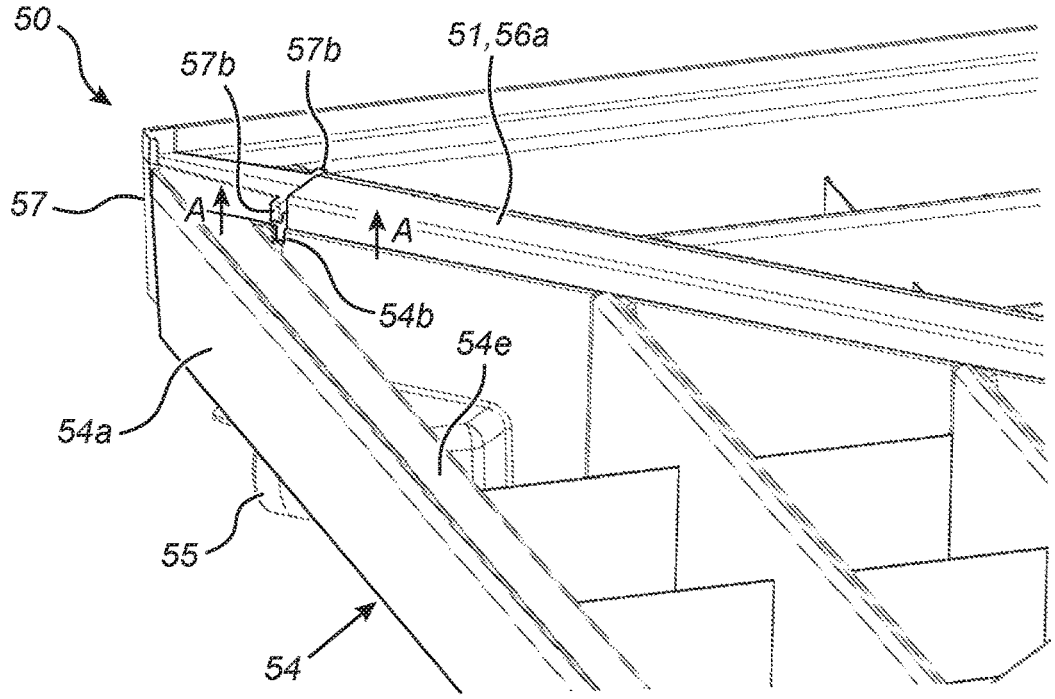
FIG. 10 shows the detail view of the corner section shown in FIG. 9, during installation of a container.

FIG. 6 shows an exploded view of another embodiment of a parasol base 50 according to the invention, FIG. 7 shows a cross-sectional view of said parasol base 50, FIG. 8 shows a bottom view of said parasol base 50, and FIG. 9 shows a detailed view of a corner section of a part of the parasol base according to FIGS. 6-8. FIGS. 6-9 are described below in more detail. The parasol base 50 comprises a support frame 51, which support frame 51 comprises four mutually fixed arms 52 extending in different directions, wherein adjacent arms 52 mutually enclose an accommodating space 53, a plurality of removable counterweight blocks 54 inserted or insertable into at least one accommodating space 53, a plurality of wheels 55, wherein each wheel 55 is connected by means of a wheel bracket 56 to a terminal portion 52*a* of an arm 52, and wherein opposing lower edges of each arm 52 are each provided with a support element 52*b* for supporting at least a portion of at least one counterweight block 54. In this exemplary embodiment, a lower side of each counterweight block 54 is positioned below an upper side of the wheels 55. Each arm 52 is formed by a plurality of interconnected beams 56*a*, 56*b*, 56*c*, 56*d* of different lengths, wherein a long upper beam 56*a* and two short upper beams 56*b* together form an upper (cruciform) part of the support frame 51, and a long lower beam 56*c* and two short lower beams 56*d* form together form a lower (cruciform) part of the support frame 51. All beams 56*a*, 56*b*, 56*c*, 56*d* are, directly or indirectly, connected to each other. The upper part of the support frame 51 extends with respect to the lower part of the support frame 51 to create space for the wheels 55 to be attached to the (lower side of the) upper part of the support frame 51. An end surface of each arm 52 is connected to a corner piece 57 defining a part of a peripheral edge of the parasol base 50. Each corner piece 57 is inserted into said end surface of the corresponding arm 52, and is secured in place by means of a pin 56*a* of the wheel bracket 56 of a wheel 55. The corner piece 57 is considered as part of the support frame 51. Each corner piece 57 is provided with an upstanding (upwardly protruding) profile or rim 57*a*. These rims 57*a* not only define an outer boundary of the parasol base 50, but also define an insertion space for a top panel 58 of the parasol base 50. The top panel 58 is typically a square (or rectangular) shaped panel or tile, commonly made from stone, ceramic, plastic, glass, and/or a composite material. In this example, the top panel 58 is provided with four mounting holes 58*a*, which are, in assembled state of the parasol base 50, positioned in line with mounting holes in the upper beams 56*a*, 56*b* of the support frame 51. The mounting holes are configured to received pins, screws and/or bolts for mounting a base bracket (not shown) onto the top panel 58, wherein said base bracket is configured to support a parasol. The mounting structure preferably corresponds to the mounting structure as shown in FIGS. 3*a* and 3*b*, wherein the base bracket is actually connected and supported by the support frame 51, as a result of which the load and forces exerted by the parasol onto the base bracket are transmitted to the support frame 51 rather than to the top panel 58, which prevents damaging of the top panel 58. Each counterweight block 54 is actually formed by a container, also referred to as a box, a tray, or a receptacle for receiving a mass increasing substance, such as sand. The container 54 has a substantially triangular cross-section and is configured to be accommodated in an accommodating space 53 enclosed by adjacent arms 52. Each container 54 is preferably at least partially made of plastic. Each container 54 has an open top surface. Each container 54 comprises a circumferential wall 54*a*, an adjoining bottom surface 54*b* and a plurality of upstanding low cross ridges 54*c* and upstanding high longitudinal ridges 54*d*. The ridges 54*c*, 54*d* provide rigidity of the container 54. The longitudinal ridges 54*d* extend to an upper level of the container 54, and are configured to support to the top panel 58. In FIG. 8 all support surfaces of the support frame 51 and the containers 54, configured to support the top panel 58, are marked. This shows that the top panel 58 (and possible further external forces exerted onto the top panel 58) is supported in a relatively distributed manner. An outer upper edge of the circumferential wall 54*a* of each container is provided with a (slightly) downwardly inclined drainage channel 54*e* to drain (rain) water, falling onto the top panel 58 and flowing into said drainage channel 54*e*, towards the corner pieces 57, where the (rain) water can flow away from the parasol base 50. The (rain) water may for example be discharged to the surroundings by means of a drainage hole, or may be drained along the side of the container, as long as it is prevented that the (rain) water could flow into a container. Each container 54 is supported by two support elements 52*b* of adjacent arms 52, respectively. In order to secure the container 54 with respect to the support frame 51, several measures are taken. Firstly, each support element 52*b* is provided with a lock hole 52*c* configured to co-act with a downward protrusion (bulge) 54*f* of a container 54. Secondly, each container 58 is additionally locked with respect to, in particular hung (suspended) to, both corner pieces 57 adjoining said container 54. To this end, each corner piece 57 is provided, at opposing side, with two hook-shaped members 57*a*, and a part of the circumferential wall 54*a* of the container 54 facing said hook-shaped members 57*b* is, in this example, provided with a recessed portion 54*b*. Each hook-shaped member 57*b* is configured to co-act with a recessed portion 54*b* to realize a locking connection between the support frame 51 and the container 54, wherein said locking connection is preferably a snap connection and/or clamp connection. FIG. 10 is quite identical to FIG. 9, though wherein the parasol base 50 is shown during installation of a container 54. More in particular, FIG. 10 shows the container 54 right before the container 54 is moved upwardly (see arrows A) to secure the container 54 in place. When the container 54 is moved in upward direction, the locking member 57*b* will be brought into contact with the recess portion 54*b* and/or (an inner side of) the circumferential wall 54*a* of the container 54 to clamp the container 54 in place and to secure the container with respect to the support frame 51.

Figure 11A:
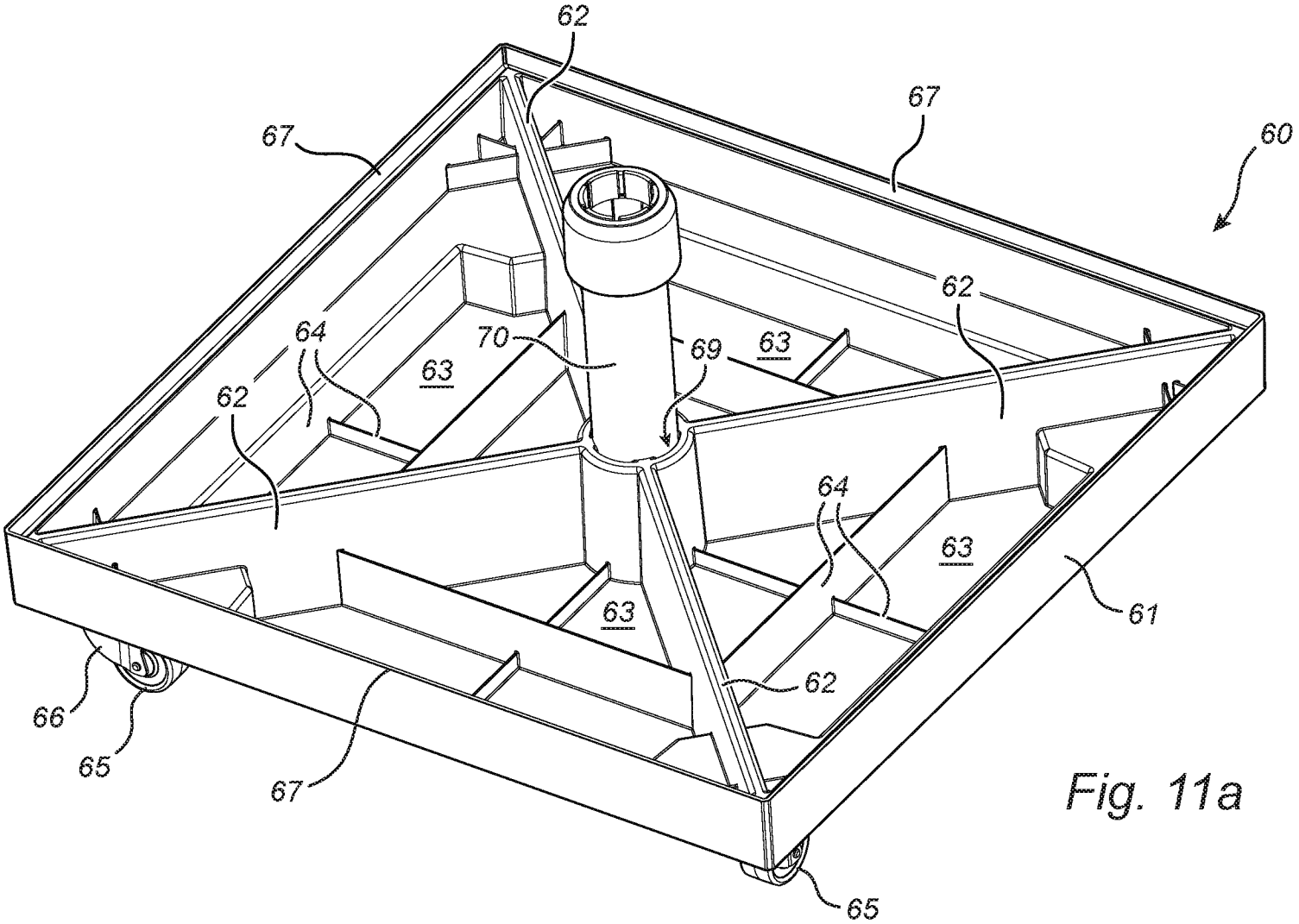
FIGS. 11*a*-11*e* show a further possible embodiment of a parasol base according to the present invention.
Figure 11B:
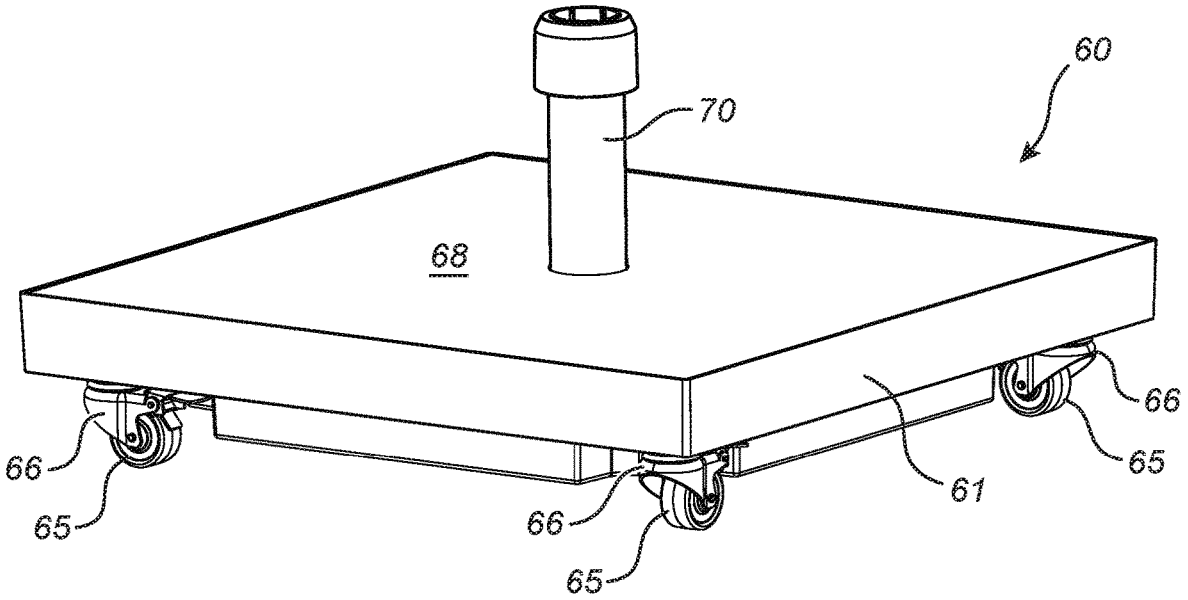
Figure 11C:
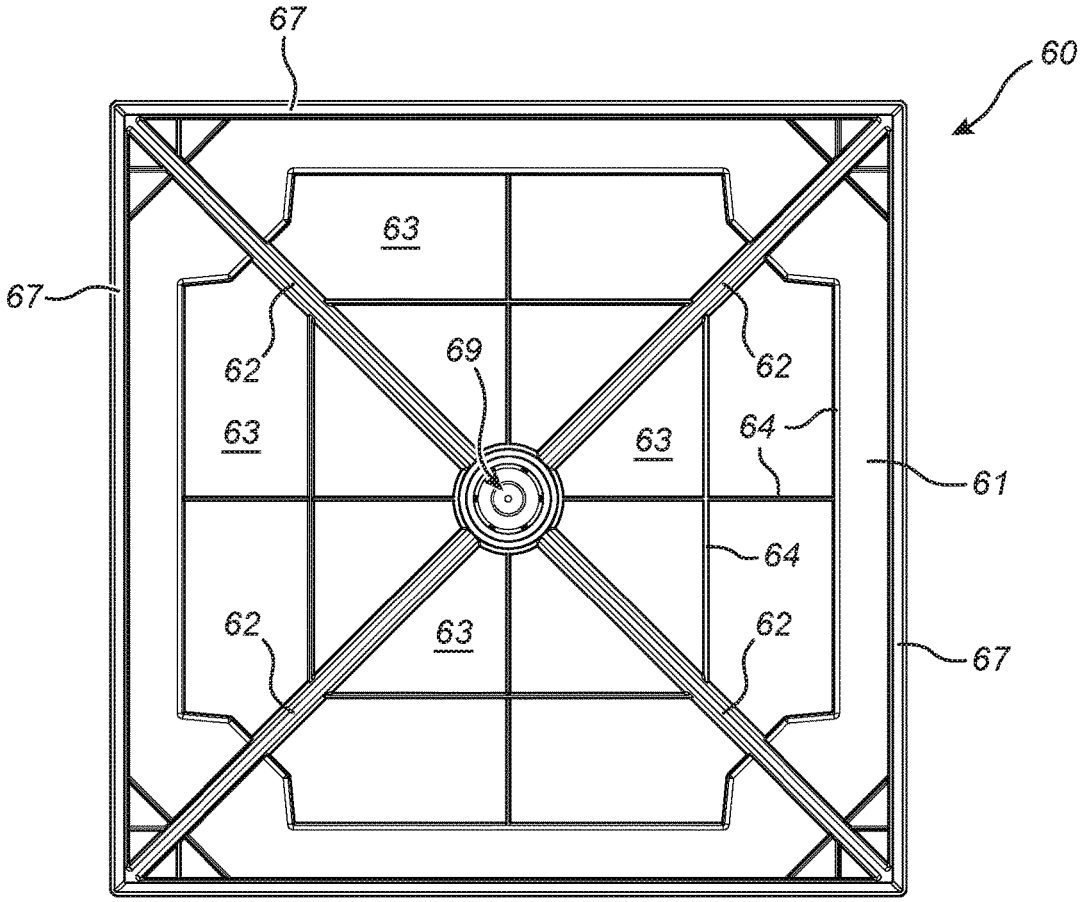
Figure 11D:
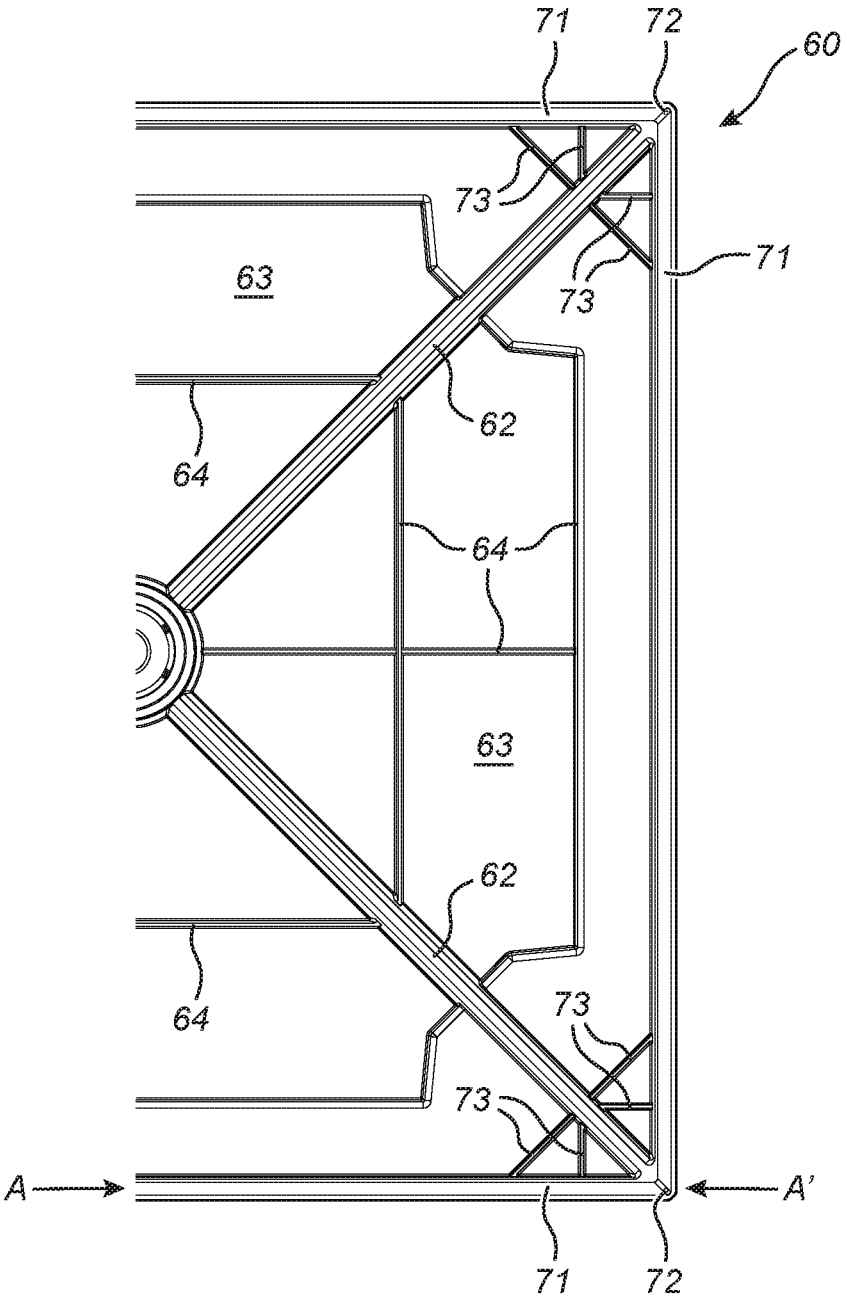
Figure 11E:
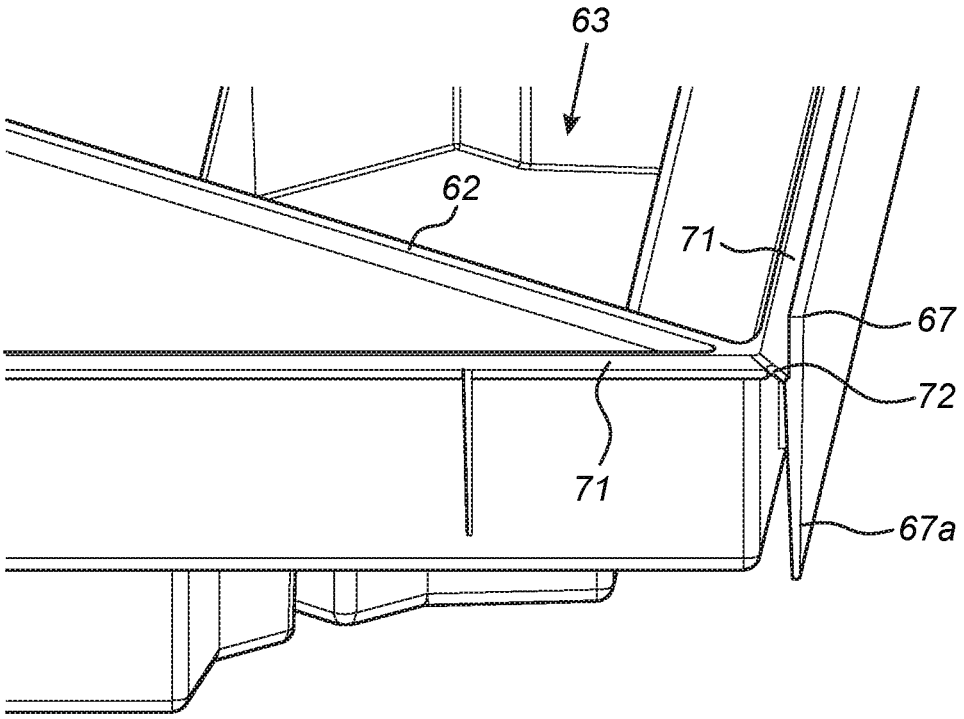

FIGS. 11*a*-11*e* shows a further possible embodiment of a parasol base 60 according to the present invention. FIGS. 11*a* and 11*b* show a perspective view, whereas FIG. 11*c* shows a top view. FIG. 11*d* shows a zoomed in portion of the top view according to FIG. 11*c*, and finally FIG. 11*e* shows a perspective view of the cross-section along line A-A' as depicted in FIG. 11*d*. The parasol base 60 comprises a support frame 61, which support frame 61 comprises four mutually fixed arms 62 extending in different directions, wherein adjacent arms 62 mutually enclose an accommodating space 63 for receiving at least one counterweight blocks (not shown) and/or a mass increasing substance, such as sand, water or the like. The parasol base 60 further comprises a plurality of wheels 65, wherein each wheel 65 is connected by means of a wheel bracket 66 to a terminal portion of an arm 62. The parasol base 60 further comprises a top panel 58 (only shown in FIG. 11*b*), which is configured to at least partially cover said support frame 61. The terminal portion of each arm 62 is provided with an upward rim 67, wherein the upward rims 67 together define a top panel insertion space in which the top panel 68 is positioned. The four arms 62 of the support frame 61 further enclose at least one receiving space 69 for receiving part of a base tube 70 configured to receive a lower end section of a parasol shaft. Adjacent arms 62 of the support frame 61 enclose multiple reinforcement ribs 64. Preferably, the support frame 61 is made of a single piece, and preferably out of plastic. FIG. 11*d* depicts that adjacent to the upward rims 67 there is a (slightly) inclined drainage channel 71. The angle of the drainage channel 71 may for example be situated between 10 and 40 degrees. Said drainage channel 71, which is downwardly inclined in a direction facing away from the centre of the parasol base 60, is provided to drain (rain) water, falling onto the top panel 68 and flowing into said drainage channel 71, towards the end portions of each arm. Each end portion of each arm is to this end provided with a drainage hole 72, which serves to allow the drained (rain) water to flow to the surroundings, and thereby preventing accumulation of (rain) water in the interior of the parasol base 60. Near the end portion of each arm the parasol base 60 may be optionally provided with a plurality of, laterally protruding, arm reinforcement ribs 73. The arm reinforcement ribs further prevent the parasol base 60 to be torn due to the forces exerted by the wheels 65, in particular the brackets 66. These arm reinforcement ribs 73 may also provide additional structural integrity to the parasol base 60.

In particular, the arm reinforcement ribs 73 may increase torsional stiffness of the parasol base 60. FIG. 11*e* depicts a more detailed view of the drainage channel 71, which is configured to transport drainage (rain) water towards the drainage hole 72. The drainage hole 72 is provided close to a terminal end portion of the arms, preferably each arm. Hence, the drainage hole 72 is provided at the location where two adjacent drainage channels 71 connect, preferably at the lowest part thereof. This is beneficial since drainage water tends to flow towards the lowest point, which in this case is formed by the drainage hole 72 which allows the water to be discharged to the surrounding. As such, (rain) water does not accumulate in the parasol base 60. The drained water will be discharged between the exterior wall of the accommodating space 63 and the exterior wall 67*a* of the parasol base 60, which in this embodiment is integrally connected to the upward rim 67. An additional advantage is that water does not flow along the exterior surfaces of the parasol base 60, hence preventing the (rain) water from staining the exterior surface whilst preventing the accommodating space 63 and/or the counterweight block to be unwantedly filled with water. Albeit in this embodiment drainage holes 72 are provided at each of the four corners, it is conceivable that the parasol base 60 may be provided with more or less drainage holes 72.

Figure 12:
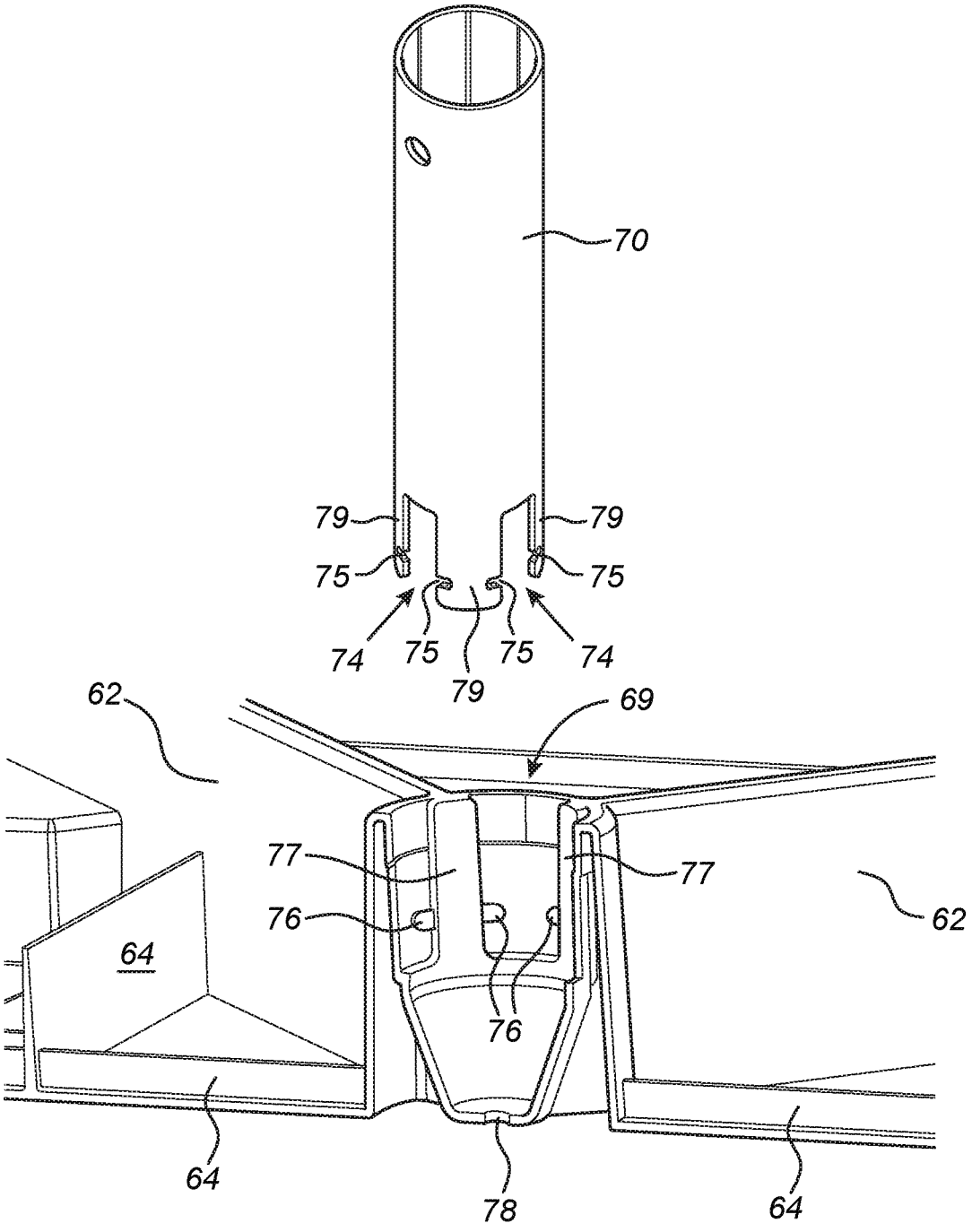
FIG. 12 shows an exploded cross sectional view of the parasol base as shown in FIG. 11*a*.

FIG. 12 depicts a cross-sectional view of the parasol base 60 and the base tube 70, as shown in FIG. 11*a*. The cross-section shows the interior part of the at least one receiving space 69 of the support frame 61 for receiving the base tube 70. At lower terminal portion of the base tube comprises axial slots 74, wherein each axial slot 74 is provided with a set of facing laterally protruding locking slots 75. The receiving space 69 comprises axially oriented guiding elements 77, which mutually enclose axial slots in which protruding locking elements 76 are situated. The protruding locking elements 76 are configured to co-act with the locking slots 75 when the base tube 70 is vertically displaced into the receiving space 69 in order to lock the base tube 70 in place. In fact, the base tube 70 snaps over (clicks over) the protruding locking elements 76, which realizes an axial locking effect. At the bottom surface of the receiving space 69 there is an additional drainage hole 78, which allows water that seeps along the shaft 70 into the receiving space 69 to be drained to the surroundings.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof.

The invention claimed is:

1. A mobile parasol base, comprising:

a support frame, which support frame comprises at least three mutually fixed arms extending in different directions, wherein adjacent arms mutually enclose an accommodating space and/or wherein the arms mutually enclose one or more accommodating spaces, wherein each accommodating space is configured to accommodate at least a mass increasing substance and/or mass increasing component, and one or more counterweight blocks inserted or insertable or creatable into at least one accommodating space, a plurality of wheels, wherein each wheel is connected by means of a wheel bracket to a terminal portion of an arm, wherein at least one arm comprises a drainage channel proximate to a terminal portion of the at least one arm and downwardly inclined in a direction facing away from a centre of the support frame.

2. The parasol base according to claim 1, wherein the accommodating spaces have substantially identical sizes or wherein the support frame comprises four mutually fixed arms extending, from a centre portion of the base, in different directions.

3. The parasol base according to claim 1, wherein each wheel is positioned underneath the terminal portion of an arm and/or wherein each wheel bracket is at least partially positioned underneath an arm and/or wherein a part of each wheel bracket is inserted into the arm and/or wherein at least one wheel has a fixed orientation with respect to the arm to which the wheel is connected and/or, wherein at least one wheel is displaceably connected to one of the arms and/or wherein each wheel has an axis of rotation, and wherein the lower side of each counterweight block is positioned in between an upper side of the wheels and an axis of rotation of the wheels.

4. The parasol base according to claim 1, wherein each arm is provided with at least one support element for supporting at least a portion of at least one counterweight block, such that a lower side of each counterweight block is positioned below an upper side of the wheels, and wherein at least one support element is positioned below an upper side of the wheel and/or wherein at least one support element is at least partially formed by a protruding rim, and/or wherein each arm is provided with at least two support elements for supporting two different counterweight blocks and/or wherein each arm is provided with at least two support elements positioned in two different accommodating spaces and/or wherein at least one support element defines a lower side of each arm and/or wherein a terminal portion of each arm has a reduced thickness with respect to the thickness of a remaining portion of each arm, wherein each wheel is connected to said terminal portion of an arm and/or wherein each arm is formed by at least one beam.

5. The parasol base according to claim 1, wherein the arms define together a single planar plane and/or wherein at least two arms are interconnected by at least one cross-bar, positioned at a distance from the centre portion of the parasol base, wherein each cross-bar is configured to support at least one counterweight block and/or wherein each counterweight block comprises a container with at least one filling opening for filling the container with a mass increasing substance, such as sand or water, wherein said at least one filling opening is closable by a closing lid and/or by a top panel of the parasol base.

6. The parasol base according to claim 1, wherein each counterweight block comprises a container, wherein said container comprises at least one bottom wall and at least one circumferential wall connecting to said bottom wall, wherein the circumferential wall defines a filling opening of the container for filling the container with a mass increasing substance, such as sand or water, wherein each container is closable by a lid and/or a top panel of the parasol base and wherein the parasol base comprises a plurality of closing lids, wherein each lid is configured to co-act with, a circumferential wall of a container for substantially closing the container.

7. The parasol base according to claim 6, wherein each container comprises at least one drainage channel to drain rain water away from the filling opening of the container and/or away from an accommodating space for the mass increasing substance.

8. The parasol base according to claim 1, wherein, in installed condition, each counterweight block extends with respect to the terminal portion of each adjacent arm and/or wherein at least a part of at least one counterweight block has a substantially triangular cross-section and/or wherein at least one counterweight block has an increasing cross-section in upward direction and/or wherein a part of a circumferential wall of each counterweight block defines a part of a peripheral edge of the parasol base and/or wherein an end surface of each arm is connected to a corner piece defining a part of a peripheral edge of the parasol base.

9. The parasol base according to claim 8, wherein, in installed condition, each corner piece is connecting, at opposite sides, to at least two counterweight blocks and wherein each corner piece comprises a support surface for supporting a top panel positioned on top of at least a portion of each corner piece, wherein each corner piece is provided with an upward rim, wherein the upward rims together define a top panel insertion space for insertion of a top panel, such that at least a part of the arm and a part of the counterweight blocks is covered by said top panel.

10. The parasol base according to claim 1, wherein an outer part of a circumferential wall of each counterweight block is provided with an upward rim, wherein the rims together define a top panel insertion space for insertion of a top panel, such that at least a part of the arm and a part of the counterweight blocks is covered by said top panel.

11. The parasol base according to claim 10, wherein the parasol base comprises at least one, top panel, removably inserted into the top panel insertion space or, wherein the height of the upward rims of the corner pieces and/or the circumferential wall of the counterweight blocks is substantially identical to the height of the top panel.

12. The parasol base according to claim 1, wherein the parasol base is configured to support a stem part or shaft part of a parasol.

13. The parasol base according to claim 1, wherein the parasol base comprises a base bracket, positioned on top of and secured with respect to the support frame and/or, if applied, the top panel, wherein said base bracket is configured to support a parasol, and wherein the parasol base comprises a clamping structure configured to clamp the base bracket onto the support frame, onto at least one upper beam of said support frame.

14. The parasol base according to claim 11, wherein the top panel is locked in between the support frame and the base bracket, or wherein the base bracket is secured with respect to the support frame, such that forces exerted onto the base bracket are substantially transmitted to the support frame rather than to the top panel.

15. The parasol base according to claim 1, wherein the accommodating space is configured for accommodating a mass increasing substance, such as a counterweight block.

16. The parasol base according to claim 1, wherein at least one accommodating space, is defined by adjacent arms, and at least one bottom wall and at least one circumferential wall situated in between said adjacent arms, wherein said bottom wall is formed by interconnected support elements of said adjacent arms and wherein the support frame, the at least one bottom wall, and the at least one circumferential wall, are formed out of a single piece.

17. The parasol base according to claim 1, wherein the arms of the support frame enclose at least one receiving space for receiving a base tube configured to receive a parasol shaft and wherein the parasol base comprises a base tube configured to receive a parasol shaft, wherein the at least one receiving space is provided with at least one locking element comprising at least one protrusion, and wherein the base tube is provided with at least one counterlocking element configured to co-act with said locking element for securing the base tube in an axial direction and wherein the at least one counterlocking element comprises at least one locking slot, wherein at least one protrusion is configured to be located in the at least one locking slot, in coupled condition of the support frame and the base tube, and wherein the at least one locking element and at least one counterlocking element define a bayonet lock closure.

18. The parasol base according to claim 17, wherein the receiving space for the base tube is provided with a drainage hole and/or wherein a terminal portion of at least one arm is provided with a plurality of arm reinforcement ribs.

19. The parasol base according to claim 1, wherein a circumferential wall of the parasol base, which partially defines the accommodating space, and/or at least one counterweight block is provided with a drainage channel.

20. The parasol base according to claim 7, wherein at least one lowest point of the bottom surface of said drainage channel is provided with at least one drainage hole and wherein said drainage hole connects the drainage channel to an underneath drainage space enclosed by spaced, walls of the parasol base, an inner wall defining a part of at least one accommodating space, and a spaced outer wall defining an exterior wall of the parasol base.

21. The assembly of a parasol base according to claim 1 and at least one parasol mounted onto said parasol base.

* * * * *